US010152915B2

(12) United States Patent
Chaji

(10) Patent No.: US 10,152,915 B2
(45) Date of Patent: Dec. 11, 2018

(54) SYSTEMS AND METHODS OF DISPLAY BRIGHTNESS ADJUSTMENT

(71) Applicant: Ignis Innovation Inc., Waterloo (CA)

(72) Inventor: Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 157 days.

(21) Appl. No.: 15/086,217

(22) Filed: Mar. 31, 2016

(65) Prior Publication Data

US 2016/0293102 A1 Oct. 6, 2016

(30) Foreign Application Priority Data

Apr. 1, 2015 (CA) ..... 2886862

(51) Int. Cl.

| | |
|---|---|
| ***G09G 3/3225*** | (2016.01) |
| ***G09G 3/3208*** | (2016.01) |
| ***G09G 3/32*** | (2016.01) |
| ***G09G 3/20*** | (2006.01) |

(52) U.S. Cl.

CPC ..... *G09G 3/32* (2013.01); *G09G 3/20* (2013.01); *G09G 3/3208* (2013.01); *G09G 3/3225* (2013.01); *G09G 2320/0233* (2013.01); *G09G 2320/041* (2013.01); *G09G 2320/043* (2013.01);

(Continued)

(58) Field of Classification Search

CPC ..... G09G 3/3225; G09G 3/3258; G09G 3/32; G09G 3/3208; G09G 3/3233; G09G 3/20; G09G 2320/0693; G09G 2320/0295; G09G 2320/0626; G09G 2320/043; G09G 2320/041; G09G 2320/029; G09G 2320/0233; G09G 2330/045; G09G 2320/0646; G09G 2320/045; G09G 3/3413; G09G 3/3291; G09G 3/3648; G09G 3/3406

See application file for complete search history.

(56) References Cited

U.S. PATENT DOCUMENTS

| | | | |
|---|---|---|---|
| 3,506,851 | A | 4/1970 | Polkinghorn et al. |
| 3,750,987 | A | 8/1973 | Gobel |
| 3,774,055 | A | 11/1973 | Bapat et al. |

(Continued)

FOREIGN PATENT DOCUMENTS

| | | |
|---|---|---|
| AU | 729652 | 6/1997 |
| AU | 764896 | 12/2001 |

(Continued)

OTHER PUBLICATIONS

Ahnood et al.: "Effect of threshold voltage instability on field effect mobility in thin film transistors deduced from constant current measurements"; dated Aug. 2009.

(Continued)

*Primary Examiner* — Dismery Mercedes
(74) *Attorney, Agent, or Firm* — Stratford Managers Corporation

(57) ABSTRACT

Systems and methods for adjusting a brightness of a display panel by periodically measuring at least one physical property in at least one area of a display panel, generating measurement data, and adjusting the brightness of the display panel with use of the measurement data. The brightness can be adjusted to control temperature and aging, in response to measurements of physical properties measured in at least one area of the display panel.

14 Claims, 9 Drawing Sheets

(52) U.S. Cl.
CPC ..... *G09G 2320/046* (2013.01); *G09G 2320/0626* (2013.01); *G09G 2330/045* (2013.01)

(56) References Cited

U.S. PATENT DOCUMENTS 4,090,096 A 5/1978 Nagami
4,354,162 A 10/1982 Wright
4,996,523 A 2/1991 Bell et al.
5,134,387 A 7/1992 Smith et al.
5,153,420 A 10/1992 Hack et al.
5,170,158 A 12/1992 Shinya
5,204,661 A 4/1993 Hack et al.
5,266,515 A 11/1993 Robb et al.
5,278,542 A 1/1994 Smith et al.
5,408,267 A 4/1995 Main
5,498,880 A 3/1996 Lee et al.
5,572,444 A 11/1996 Lentz et al.
5,589,847 A 12/1996 Lewis
5,619,033 A 4/1997 Weisfield
5,648,276 A 7/1997 Hara et al.
5,670,973 A 9/1997 Bassetti et al.
5,691,783 A 11/1997 Numao et al.
5,701,505 A 12/1997 Yamashita et al.
5,714,968 A 2/1998 Ikeda
5,744,824 A 4/1998 Kousai et al.
5,745,660 A 4/1998 Kolpatzik et al.
5,748,160 A 5/1998 Shieh et al.
5,758,129 A 5/1998 Gray et al.
5,835,376 A 11/1998 Smith et al.
5,870,071 A 2/1999 Kawahata
5,874,803 A 2/1999 Garbuzov et al.
5,880,582 A 3/1999 Sawada
5,903,248 A 5/1999 Irwin
5,917,280 A 6/1999 Burrows et al.
5,949,398 A 9/1999 Kim
5,952,789 A 9/1999 Stewart et al.
5,990,629 A 11/1999 Yamada et al.
6,023,259 A 2/2000 Howard et al.
6,069,365 A 5/2000 Chow et al.
6,091,203 A 7/2000 Kawashima et al.
6,097,360 A 8/2000 Holloman
6,100,868 A 8/2000 Lee et al.
6,144,222 A 11/2000 Ho
6,229,506 B1 5/2001 Dawson et al.
6,229,508 B1 5/2001 Kane
6,246,180 B1 6/2001 Nishigaki
6,252,248 B1 6/2001 Sano et al.
6,268,841 B1 7/2001 Cairns et al.
6,288,696 B1 9/2001 Holloman
6,307,322 B1 10/2001 Dawson et al.
6,310,962 B1 10/2001 Chung et al.
6,323,631 B1 11/2001 Juang
6,333,729 B1 12/2001 Ha
6,384,804 B1 5/2002 Dodabalapur et al.
6,388,653 B1 5/2002 Goto et al.
6,392,617 B1 5/2002 Gleason
6,396,469 B1 5/2002 Miwa et al.
6,414,661 B1 7/2002 Shen et al.
6,417,825 B1 7/2002 Stewart et al.
6,430,496 B1 8/2002 Smith et al.
6,433,488 B1 8/2002 Bu
6,473,065 B1 10/2002 Fan
6,475,845 B2 11/2002 Kimura
6,501,098 B2 12/2002 Yamazaki
6,501,230 B1 * 12/2002 Feldman ..... G09G 3/3216 315/169.3
6,501,466 B1 12/2002 Yamagashi et al.
6,522,315 B2 2/2003 Ozawa et al.
6,535,185 B2 3/2003 Kim et al.
6,542,138 B1 4/2003 Shannon et al.
6,559,839 B1 5/2003 Ueno et al.
6,580,408 B1 6/2003 Bae et al.
6,583,398 B2 6/2003 Harkin
6,618,030 B2 9/2003 Kane et al.
6,639,244 B1 10/2003 Yamazaki et al.
6,680,580 B1 1/2004 Sung
6,686,699 B2 2/2004 Yumoto
6,690,000 B1 2/2004 Muramatsu et al.
6,693,610 B2 2/2004 Shannon et al.
6,694,248 B2 2/2004 Smith et al.
6,697,057 B2 2/2004 Koyama et al.
6,724,151 B2 4/2004 Yoo
6,734,636 B2 5/2004 Sanford et al.
6,753,655 B2 6/2004 Shih et al.
6,753,834 B2 6/2004 Mikami et al.
6,756,741 B2 6/2004 Li
6,756,958 B2 6/2004 Furuhashi et al.
6,777,888 B2 8/2004 Kondo
6,781,567 B2 8/2004 Kimura
6,788,231 B1 9/2004 Hsueh
6,809,706 B2 10/2004 Shimoda
6,828,950 B2 12/2004 Koyama
6,858,991 B2 2/2005 Miyazawa
6,859,193 B1 2/2005 Yumoto
6,876,346 B2 4/2005 Anzai et al.
6,900,485 B2 5/2005 Lee
6,903,734 B2 6/2005 Eu
6,911,960 B1 6/2005 Yokoyama
6,911,964 B2 6/2005 Lee et al.
6,914,448 B2 7/2005 Jinno
6,919,871 B2 7/2005 Kwon
6,924,602 B2 8/2005 Komiya
6,937,220 B2 8/2005 Kitaura et al.
6,940,214 B1 9/2005 Komiya et al.
6,954,194 B2 10/2005 Matsumoto et al.
6,970,149 B2 11/2005 Chung et al.
6,975,142 B2 12/2005 Azami et al.
6,975,332 B2 12/2005 Arnold et al.
6,995,519 B2 2/2006 Arnold et al.
7,027,015 B2 4/2006 Booth, Jr. et al.
7,034,793 B2 4/2006 Sekiya et al.
7,038,392 B2 5/2006 Libsch et al.
7,057,588 B2 6/2006 Asano et al.
7,061,451 B2 6/2006 Kimura
7,071,932 B2 7/2006 Libsch et al.
7,106,285 B2 9/2006 Naugler
7,112,820 B2 9/2006 Chang et al.
7,113,864 B2 9/2006 Smith et al.
7,122,835 B1 10/2006 Ikeda et al.
7,129,914 B2 10/2006 Knapp et al.
7,164,417 B2 1/2007 Cok
7,224,332 B2 5/2007 Cok
7,248,236 B2 7/2007 Nathan et al.
7,259,737 B2 8/2007 Ono et al.
7,262,753 B2 * 8/2007 Tanghe ..... G09G 3/3216 345/101
7,274,363 B2 9/2007 Ishizuka et al.
7,310,092 B2 12/2007 Imamura
7,315,295 B2 1/2008 Kimura
7,317,434 B2 1/2008 Lan et al.
7,321,348 B2 1/2008 Cok et al.
7,327,357 B2 2/2008 Jeong
7,333,077 B2 2/2008 Koyama et al.
7,343,243 B2 3/2008 Smith et al.
7,414,600 B2 8/2008 Nathan et al.
7,466,166 B2 12/2008 Date et al.
7,495,501 B2 2/2009 Iwabuchi et al.
7,502,000 B2 3/2009 Yuki et al.
7,515,124 B2 4/2009 Yaguma et al.
7,535,449 B2 5/2009 Miyazawa
7,554,512 B2 6/2009 Steer
7,567,229 B2 * 7/2009 Kasai ..... G09G 3/2014 345/690
7,569,849 B2 8/2009 Nathan et al.
7,595,776 B2 9/2009 Hashimoto et al.
7,604,718 B2 10/2009 Zhang et al.
7,609,239 B2 10/2009 Chang
7,612,745 B2 11/2009 Yumoto et al.
7,619,594 B2 11/2009 Hu
7,619,597 B2 * 11/2009 Nathan ..... G09G 3/3233 345/82
7,639,211 B2 12/2009 Miyazawa
7,683,899 B2 3/2010 Hirakata et al.

(56) References Cited

U.S. PATENT DOCUMENTS 7,688,289 B2 3/2010 Abe et al.
7,760,162 B2 7/2010 Miyazawa
7,808,008 B2 10/2010 Miyake
7,859,520 B2 12/2010 Kimura
7,889,159 B2 2/2011 Nathan et al.
7,903,127 B2 3/2011 Kwon
7,920,116 B2 4/2011 Woo et al.
7,944,414 B2 5/2011 Shirasaki et al.
7,978,170 B2 7/2011 Park et al.
7,989,392 B2 8/2011 Crockett et al.
7,995,008 B2 8/2011 Miwa
8,063,852 B2 11/2011 Kwak et al.
8,102,343 B2 1/2012 Yatabe
8,144,081 B2 3/2012 Miyazawa
8,159,007 B2 4/2012 Bama et al.
8,242,979 B2 8/2012 Anzai et al.
8,253,665 B2 8/2012 Nathan et al.
8,283,967 B2 10/2012 Chaji et al.
8,319,712 B2 11/2012 Nathan et al.
8,564,513 B2 10/2013 Nathan et al.
8,589,100 B2 * 11/2013 Chaji ..... G09G 3/32 702/64
8,786,589 B2 * 7/2014 Park ..... G09G 3/3225 345/211
8,872,739 B2 10/2014 Kimura
9,111,485 B2 * 8/2015 Chaji ..... G09G 3/3208
9,134,825 B2 * 9/2015 Chaji ..... G06F 3/038
9,384,698 B2 * 7/2016 Chaji ..... G09G 3/3291
9,773,441 B2 * 9/2017 Chaji ..... G09G 3/006
9,786,209 B2 * 10/2017 Chaji ..... G09G 3/006
2001/0002703 A1 6/2001 Koyama
2001/0009283 A1 7/2001 Arao et al.
2001/0024186 A1 9/2001 Kane et al.
2001/0026257 A1 10/2001 Kimura
2001/0030323 A1 10/2001 Ikeda
2001/0035863 A1 11/2001 Kimura
2001/0040541 A1 11/2001 Yoneda et al.
2001/0043173 A1 11/2001 Troutman
2001/0045929 A1 11/2001 Prache
2001/0052940 A1 12/2001 Hagihara et al.
2002/0000576 A1 1/2002 Inukai
2002/0011796 A1 1/2002 Koyama
2002/0011799 A1 1/2002 Kimura
2002/0012057 A1 1/2002 Kimura
2002/0030190 A1 3/2002 Ohtani et al.
2002/0047565 A1 4/2002 Nara et al.
2002/0052086 A1 5/2002 Maeda
2002/0080108 A1 6/2002 Wang
2002/0084463 A1 7/2002 Sanford et al.
2002/0101172 A1 8/2002 Bu
2002/0117722 A1 8/2002 Osada et al.
2002/0140712 A1 10/2002 Ouchi et al.
2002/0158587 A1 10/2002 Komiya
2002/0158666 A1 10/2002 Azami et al.
2002/0158823 A1 10/2002 Zavracky et al.
2002/0171613 A1 11/2002 Goto et al.
2002/0181275 A1 12/2002 Yamazaki
2002/0186214 A1 12/2002 Siwinski
2002/0190971 A1 12/2002 Nakamura et al.
2002/0195967 A1 12/2002 Kim et al.
2002/0195968 A1 12/2002 Sanford et al.
2002/0196213 A1 12/2002 Akimoto et al.
2003/0001828 A1 1/2003 Asano
2003/0001858 A1 1/2003 Jack
2003/0016190 A1 1/2003 Kondo
2003/0020413 A1 1/2003 Oomura
2003/0030603 A1 2/2003 Shimoda
2003/0062524 A1 4/2003 Kimura
2003/0062844 A1 4/2003 Miyazawa
2003/0076048 A1 4/2003 Rutherford
2003/0090445 A1 5/2003 Chen et al.
2003/0090447 A1 5/2003 Kimura
2003/0090481 A1 5/2003 Kimura
2003/0095087 A1 5/2003 Libsch
2003/0098829 A1 5/2003 Chen et al.
2003/0107560 A1 6/2003 Yumoto et al.
2003/0107561 A1 6/2003 Uchino et al.
2003/0111966 A1 6/2003 Mikami et al.
2003/0112205 A1 6/2003 Yamada
2003/0112208 A1 6/2003 Okabe et al.
2003/0117348 A1 6/2003 Knapp et al.
2003/0122474 A1 7/2003 Lee
2003/0122747 A1 7/2003 Shannon et al.
2003/0128199 A1 7/2003 Kimura
2003/0132929 A1 * 7/2003 Woo ..... G06F 1/203 345/211
2003/0151569 A1 8/2003 Lee et al.
2003/0156104 A1 8/2003 Morita
2003/0169241 A1 9/2003 LeChevalier
2003/0169247 A1 9/2003 Kawabe et al.
2003/0174152 A1 9/2003 Noguchi
2003/0179626 A1 9/2003 Sanford et al.
2003/0185438 A1 10/2003 Osawa et al.
2003/0189535 A1 10/2003 Matsumoto et al.
2003/0197663 A1 10/2003 Lee et al.
2003/0214465 A1 11/2003 Kimura
2003/0227262 A1 12/2003 Kwon
2003/0230141 A1 12/2003 Gilmour et al.
2003/0230980 A1 12/2003 Forrest et al.
2004/0004589 A1 1/2004 Shih
2004/0032382 A1 2/2004 Cok et al.
2004/0041750 A1 3/2004 Abe
2004/0066357 A1 4/2004 Kawasaki
2004/0070557 A1 4/2004 Asano et al.
2004/0070558 A1 4/2004 Cok
2004/0090186 A1 5/2004 Yoshida et al.
2004/0095338 A1 5/2004 Takashi
2004/0129933 A1 7/2004 Nathan et al.
2004/0130516 A1 7/2004 Nathan et al.
2004/0135749 A1 7/2004 Kondakov et al.
2004/0145547 A1 7/2004 Oh
2004/0150595 A1 8/2004 Kasai
2004/0155841 A1 8/2004 Kasai
2004/0171619 A1 9/2004 Barkoczy et al.
2004/0174349 A1 9/2004 Libsch
2004/0174354 A1 9/2004 Ono
2004/0183759 A1 9/2004 Stevenson et al.
2004/0189627 A1 9/2004 Shirasaki et al.
2004/0196275 A1 10/2004 Hattori
2004/0227697 A1 11/2004 Mori
2004/0239696 A1 12/2004 Okabe
2004/0251844 A1 12/2004 Hashido et al.
2004/0252085 A1 12/2004 Miyagawa
2004/0252089 A1 12/2004 Ono et al.
2004/0256617 A1 12/2004 Yamada et al.
2004/0257353 A1 12/2004 Imamura et al.
2004/0257355 A1 12/2004 Naugler
2004/0263437 A1 12/2004 Hattori
2005/0007357 A1 1/2005 Yamashita et al.
2005/0007392 A1 * 1/2005 Kasai ..... G09G 3/2014 345/690
2005/0030267 A1 * 2/2005 Tanghe ..... G09G 3/3216 345/82
2005/0052379 A1 3/2005 Waterman
2005/0057459 A1 3/2005 Miyazawa
2005/0067970 A1 3/2005 Libsch et al.
2005/0067971 A1 3/2005 Kane
2005/0083270 A1 4/2005 Miyazawa
2005/0110420 A1 5/2005 Arnold et al.
2005/0110727 A1 5/2005 Shin
2005/0123193 A1 6/2005 Lamberg et al.
2005/0140600 A1 6/2005 Kim et al.
2005/0140610 A1 6/2005 Smith et al.
2005/0145891 A1 7/2005 Abe
2005/0156831 A1 7/2005 Yamazaki et al.
2005/0168416 A1 8/2005 Hashimoto et al.
2005/0206590 A1 9/2005 Sasaki et al.
2005/0212787 A1 9/2005 Noguchi et al.
2005/0219188 A1 10/2005 Kawabe et al.
2005/0243037 A1 11/2005 Eom et al.
2005/0248515 A1 11/2005 Naugler et al.
2005/0258867 A1 11/2005 Miyazawa
2005/0280766 A1 * 12/2005 Johnson ..... G09G 3/3216 349/167

(56) References Cited

U.S. PATENT DOCUMENTS

2005/0285822 A1 12/2005 Reddy et al.
2005/0285825 A1 12/2005 Eom et al.
2006/0012311 A1 1/2006 Ogawa
2006/0022305 A1 2/2006 Yamashita
2006/0038750 A1 2/2006 Inoue et al.
2006/0038758 A1 2/2006 Routley et al.
2006/0038762 A1 2/2006 Chou
2006/0066533 A1 3/2006 Sato et al.
2006/0077077 A1 4/2006 Kwon
2006/0077134 A1 4/2006 Hector
2006/0077194 A1 4/2006 Jeong
2006/0092185 A1 5/2006 Jo et al.
2006/0114196 A1 6/2006 Shin
2006/0125408 A1 6/2006 Nathan et al.
2006/0125740 A1 6/2006 Shirasaki et al.
2006/0139253 A1 6/2006 Choi et al.
2006/0145964 A1 7/2006 Park et al.
2006/0158402 A1 7/2006 Nathan
2006/0191178 A1 8/2006 Sempel et al.
2006/0202630 A1* 9/2006 Yamada ..... G09G 3/3208 315/169.2
2006/0208971 A1 9/2006 Deane
2006/0209012 A1 9/2006 Hagood, IV
2006/0214888 A1 9/2006 Schneider et al.
2006/0221009 A1 10/2006 Miwa
2006/0227082 A1 10/2006 Ogata et al.
2006/0232522 A1 10/2006 Roy et al.
2006/0244391 A1 11/2006 Shishido et al.
2006/0244697 A1 11/2006 Lee et al.
2006/0261841 A1 11/2006 Fish
2006/0279478 A1 12/2006 Ikegami
2006/0290614 A1 12/2006 Nathan et al.
2007/0001939 A1 1/2007 Hashimoto et al.
2007/0001945 A1 1/2007 Yoshida et al.
2007/0008251 A1 1/2007 Kohno et al.
2007/0008297 A1 1/2007 Bassetti
2007/0035489 A1 2/2007 Lee
2007/0035707 A1 2/2007 Margulis
2007/0040773 A1 2/2007 Lee et al.
2007/0040782 A1 2/2007 Woo et al.
2007/0057873 A1 3/2007 Uchino et al.
2007/0057874 A1 3/2007 Le Roy et al.
2007/0063932 A1 3/2007 Nathan et al.
2007/0075957 A1 4/2007 Chen
2007/0080908 A1 4/2007 Nathan et al.
2007/0085801 A1 4/2007 Park et al.
2007/0109232 A1 5/2007 Yamamoto et al.
2007/0128583 A1 6/2007 Miyazawa
2007/0164941 A1 7/2007 Park et al.
2007/0182671 A1 8/2007 Nathan et al.
2007/0236430 A1 10/2007 Fish
2007/0236440 A1 10/2007 Wacyk et al.
2007/0241999 A1 10/2007 Lin
2007/0242008 A1 10/2007 Cummings
2008/0001544 A1 1/2008 Murakami et al.
2008/0043044 A1 2/2008 Woo et al.
2008/0048951 A1 2/2008 Naugler et al.
2008/0055134 A1 3/2008 Li et al.
2008/0062106 A1 3/2008 Tseng
2008/0088549 A1 4/2008 Nathan et al.
2008/0094426 A1 4/2008 Kimpe
2008/0111766 A1 5/2008 Uchino et al.
2008/0122819 A1 5/2008 Cho et al.
2008/0074360 A1 6/2008 Lu et al.
2008/0129906 A1 6/2008 Lin et al.
2008/0198103 A1 8/2008 Toyomura et al.
2008/0219232 A1 9/2008 Heubel et al.
2008/0228562 A1 9/2008 Smith et al.
2008/0231625 A1 9/2008 Minami et al.
2008/0231641 A1 9/2008 Miyashita
2008/0265786 A1 10/2008 Koyama
2008/0290805 A1 11/2008 Yamada et al.
2009/0009459 A1 1/2009 Miyashita
2009/0015532 A1 1/2009 Katayama et al.
2009/0058789 A1 3/2009 Hung et al.
2009/0121988 A1 5/2009 Amo et al.
2009/0146926 A1 6/2009 Sung et al.
2009/0153448 A1 6/2009 Tomida et al.
2009/0153459 A9 6/2009 Han et al.
2009/0167644 A1* 7/2009 White ..... G09G 3/3233 345/76
2009/0174628 A1 7/2009 Wang et al.
2009/0201230 A1 8/2009 Smith
2009/0201281 A1 8/2009 Routley et al.
2009/0206764 A1 8/2009 Schemmann et al.
2009/0225011 A1 9/2009 Choi
2009/0244046 A1 10/2009 Seto
2009/0251486 A1 10/2009 Sakakibara et al.
2009/0273550 A1* 11/2009 Vieri ..... G09G 3/3648 345/87
2009/0278777 A1 11/2009 Wang et al.
2009/0289964 A1 11/2009 Miyachi
2009/0295423 A1 12/2009 Levey
2010/0026725 A1 2/2010 Smith
2010/0033469 A1 2/2010 Nathan
2010/0039451 A1 2/2010 Jung
2010/0039453 A1 2/2010 Nathan et al.
2010/0045646 A1 2/2010 Kishi
2010/0079419 A1 4/2010 Shibusawa
2010/0134475 A1 6/2010 Ogura
2010/0141564 A1 6/2010 Choi et al.
2010/0194670 A1* 8/2010 Cok ..... G09G 3/3225 345/76
2010/0207920 A1 8/2010 Chaji et al.
2010/0225634 A1 9/2010 Levey et al.
2010/0251295 A1 9/2010 Amento et al.
2010/0269889 A1 10/2010 Reinhold et al.
2010/0277400 A1 11/2010 Jeong
2010/0315319 A1 12/2010 Cok et al.
2010/0315449 A1 12/2010 Chaji
2011/0050741 A1 3/2011 Jeong
2011/0063197 A1 3/2011 Chung et al.
2011/0069089 A1 3/2011 Kopf et al.
2011/0074762 A1 3/2011 Shirasaki
2011/0084993 A1 4/2011 Kawabe
2011/0109350 A1 5/2011 Chaji et al.
2011/0169805 A1 7/2011 Katsunori
2011/0191042 A1 8/2011 Chaji
2011/0205221 A1 8/2011 Lin
2012/0026146 A1 2/2012 Kim
2012/0169793 A1 7/2012 Nathan
2012/0242633 A1* 9/2012 Kim ..... G09G 3/20 345/207
2012/0299973 A1* 11/2012 Jaffari ..... G09G 3/3208 345/690
2012/0299976 A1 11/2012 Chen et al.
2012/0299978 A1 11/2012 Chaji
2013/0321361 A1* 12/2013 Lynch ..... G09G 3/3225 345/204
2014/0267215 A1 9/2014 Soni

FOREIGN PATENT DOCUMENTS

CA 1 294 034 1/1992
CA 2 249 592 7/1998
CA 2 303 302 3/1999
CA 2 368 386 9/1999
CA 2 242 720 1/2000
CA 2 354 018 6/2000
CA 2 432 530 7/2002
CA 2 436 451 8/2002
CA 2 507 276 8/2002
CA 2 463 653 1/2004
CA 2 498 136 3/2004
CA 2 522 396 11/2004
CA 2 438 363 2/2005
CA 2 443 206 3/2005
CA 2 519 097 3/2005
CA 2 472 671 12/2005
CA 2 523 841 1/2006
CA 2 567 076 1/2006
CA 2 495 726 7/2006
CA 2 557 713 11/2006

(56) References Cited

FOREIGN PATENT DOCUMENTS

| | | | |
|---|---|---|---|
| CA | 2 526 782 | C | 8/2007 |
| CA | 2 651 893 | | 11/2007 |
| CA | 2 672 590 | | 10/2009 |
| CN | 1601594 | A | 3/2005 |
| CN | 1886774 | | 12/2006 |
| CN | 101395653 | | 3/2009 |
| DE | 202006007613 | | 9/2006 |
| EP | 0 478 186 | | 4/1992 |
| EP | 1 028 471 | A | 8/2000 |
| EP | 1 130 565 | A1 | 9/2001 |
| EP | 1 194 013 | | 4/2002 |
| EP | 1 321 922 | | 6/2003 |
| EP | 1 335 430 | A1 | 8/2003 |
| EP | 1 381 019 | | 1/2004 |
| EP | 1 429 312 | A | 6/2004 |
| EP | 1 439 520 | A2 | 7/2004 |
| EP | 1 465 143 | A | 10/2004 |
| EP | 1 473 689 | A | 11/2004 |
| EP | 1 517 290 | A2 | 3/2005 |
| EP | 1 521 203 | A2 | 4/2005 |
| GB | 2 399 935 | | 9/2004 |
| GB | 2 460 018 | | 11/2009 |
| JP | 09 090405 | | 4/1997 |
| JP | 10-254410 | | 9/1998 |
| JP | 11 231805 | | 8/1999 |
| JP | 2002-278513 | | 9/2002 |
| JP | 2003-076331 | | 3/2003 |
| JP | 2003-099000 | | 4/2003 |
| JP | 2003-173165 | | 6/2003 |
| JP | 2003-186439 | | 7/2003 |
| JP | 2003-195809 | | 7/2003 |
| JP | 2003-271095 | | 9/2003 |
| JP | 2003-308046 | | 10/2003 |
| JP | 2004-054188 | | 2/2004 |
| JP | 2004-226960 | | 8/2004 |
| JP | 2005-004147 | | 1/2005 |
| JP | 2005-099715 | | 4/2005 |
| JP | 2005-258326 | | 9/2005 |
| JP | 2005-338819 | | 12/2005 |
| TW | 569173 | | 1/2004 |
| TW | 200526065 | | 8/2005 |
| TW | 1239501 | | 9/2005 |
| WO | WO 98/11554 | | 3/1998 |
| WO | WO 99/48079 | | 9/1999 |
| WO | WO 01/27910 | A1 | 4/2001 |
| WO | WO 02/067327 | A | 8/2002 |
| WO | WO 03/034389 | | 4/2003 |
| WO | WO 03/063124 | | 7/2003 |
| WO | WO 03/075256 | | 9/2003 |
| WO | WO 2004/003877 | | 1/2004 |
| WO | WO 2004/015668 | A1 | 2/2004 |
| WO | WO 2004/034364 | | 4/2004 |
| WO | WO 2005/022498 | | 3/2005 |
| WO | WO 2005/055185 | | 6/2005 |
| WO | WO 2005/055186 | A1 | 6/2005 |
| WO | WO 2005/069267 | | 7/2005 |
| WO | WO 2005/122121 | | 12/2005 |
| WO | WO 2006/063448 | | 6/2006 |
| WO | WO 2006/128069 | | 11/2006 |
| WO | WO 2007/079572 | | 7/2007 |
| WO | WO 2008/057369 | | 5/2008 |
| WO | WO 2008/0290805 | | 11/2008 |
| WO | WO 2009/059028 | | 5/2009 |
| WO | WO 2009/127065 | | 10/2009 |
| WO | WO 2010/066030 | | 6/2010 |
| WO | WO 2010/120733 | | 10/2010 |

OTHER PUBLICATIONS

Alexander et al.: "Pixel circuits and drive schemes for glass and elastic AMOLED displays"; dated Jul. 2005 (9 pages).
Alexander et al.: "Unique Electrical Measurement Technology for Compensation Inspection and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision fast current source for large-area current-programmed a-Si flat panels"; dated Sep. 2006 (4 pages).
Chaji et al.: "Low-Cost AMOLED Television with Ignis Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High-Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated May 2008 (177 pages).
Chapter 3: Color Spaces"Keith Jack: "Video Demystified: "A Handbook for the Digital Engineer" 2001 Referex ORD-0000-00-00 USA EP040425529 ISBN: 1-878707-56-6 pp. 32-33.
Chapter 8: Alternative Flat Panel Display 1-25 Technologies; Willem den Boer: "Active Matrix Liquid Crystal Display: Fundamen-

(56) References Cited

OTHER PUBLICATIONS tals and Applications" 2005 Referex ORD-0000-00-00 U.K.; XP040426102 ISBN: 0-7506-7813-5 pp. 206-209 p. 208.
European Partial Search Report Application No. 12 15 6251.6 European Patent Office dated May 30, 2012 (7 pages).
European Patent Office Communication Application No. 05 82 1114 dated Jan. 11, 2013 (9 pages).
European Patent Office Communication with Supplemental European Search Report for EP Application No. 07 70 1644.2 dated Aug. 18, 2009 (12 pages).
European Search Report Application No. 10 83 4294.0-1903 dated Apr. 8, 2013 (9 pages).
European Search Report Application No. EP 05 80 7905 dated Apr. 2, 2009 (5 pages).
European Search Report Application No. EP 05 82 1114 dated Mar. 27, 2009 (2 pages).
European Search Report Application No. EP 07 70 1644 dated Aug. 5, 2009.
European Search Report Application No. EP 10 17 5764 dated Oct. 18, 2010 (2 pages).
European Search Report Application No. EP 10 82 9593.2 European Patent Office dated May 17, 2013 (7 pages).
European Search Report Application No. EP 12 15 6251.6 European Patent Office dated Oct. 12. 2012 (18 pages).
European Search Report Application No. EP. 11 175 225.9 dated Nov. 4, 2011 (9 pages).
European Supplementary Search Report Application No. EP 09 80 2309 dated May 8, 2011 (14 pages).
European Supplementary Search Report Application No. EP 09 83 1339.8 dated Mar. 26, 2012 (11 pages).
Extended European Search Report Application No. EP 06 75 2777.0 dated Dec. 6, 2010 (21 pages).
Extended European Search Report Application No. EP 09 73 2338.0 dated May 24, 2011 (8 pages).
Extended European Search Report Application No. EP 11 17 5223, 4 dated Nov. 8, 2011 (8 pages).
Extended European Search Report Application No. EP 12 17 4465.0 European Patent Office dated Sep. 7, 2012 (9 pages).
Fan et al. "LTPS_TFT Pixel Circuit Compensation for TFT Threshold Voltage Shift and IR-Drop on the Power Line for Amolded Displays" 5 pages copyright 2012.
Goh et al. "A New a-Si:H Thin-Film Transistor Pixel Circuit for Active-Matrix Organic Light-Emitting Diodes" IEEE Electron Device Letters vol. 24 No. 9 Sep. 2003 pp. 583-585.
International Search Report Application No. PCT/CA2005/001844 dated Mar. 28, 2006 (2 pages).
International Search Report Application No. PCT/CA2006/000941 dated Oct. 3, 2006 (2 pages).
International Search Report Application No. PCT/CA2007/000013 dated May 7, 2007.
International Search Report Application No. PCT/CA2009/001049 dated Dec. 7, 2009 (4 pages).
International Search Report Application No. PCT/CA2009/001769 dated Apr. 8, 2010.
International Search Report Application No. PCT/IB2010/002898 Canadian Intellectual Property Office dated Jul. 28, 2009 (5 pages).
International Search Report Application No. PCT/IB2010/055481 dated Apr. 7, 2011 (3 pages).
International Search Report Application No. PCT/IB2011/051103 dated Jul. 8, 2011 3 pages.
International Search Report Application No. PCT/IB2012/052651 5 pages dated Sep. 11, 2012.
International Searching Authority Written Opinion Application No. PCT/IB2010/055481 dated Apr. 7, 2011 (6 pages ).
International Searching Authority Written Opinion Application No. PCT/IB2012/052651 6 pages dated Sep. 11, 2012.
International Searching Authority Written Opinion Application No. PCT/IB2011/051103 dated Jul. 8, 2011 6 pages.
International Searching Authority Written Opinion Application No. PCT/IB2010/002898 Canadian Intellectual Property Office dated Mar. 30, 2011 (8 pages).
International Searching Authority Written Opinion Application No. PCT/CA2009/001769 dated Apr. 8, 2010 (8 pages).
Jafarabadiashtiani et al.: "A New Driving Method for a-Si AMOLED Displays Based on Voltage Feedback"; dated May 2005 (4 pages).
Lee et al.: "Ambipolar Thin-Film Transistors Fabricated by PECVD Nanociystalline Silicon"; dated May 2006 (6 pages).
Ma e y et al: "Organic Light-Emitting Diode/Thin Film Transistor Integration for foldable Displays" Conference record of the 1997 International display research conference and international workshops on LCD technology and emissive technology. Toronto Sep. 15-19, 1997 (6 pages).
Matsueda y et al.: "35.1: 2.5-in. AMOLED with Integrated 6-bit Gamma Compensated Digital Data Driver"; dated May 2004 (4 pages).
Nathan et al. "Amorphous Silicon Thin Film Transistor Circuit Integration for Organic LED Displays on Glass and Plastic" IEEE Journal of Solid-State Circuits vol. 39 No. 9 Sep. 2004 pp. 1477-1486.
Nathan et al.: "Backplane Requirements for Active Matrix Organic Light Emitting Diode Displays"; dated Sep. 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a-Si for AMOLED—Meeting the Performance and Cost Demands of Display Applications (Cell Phone to HDTV)"; dated Jun. 2006 (4 pages).
Nathan et al.: "Thin film imaging technology on glass and plastic"; dated Oct. 31-Nov. 2, 2000 (4 pages).
Ono et al. "Shared Pixel Compensation Circuit for AM-OLED Displays " Proceedings of the 9th Asian Symposium on Information Display (ASID) pp. 462-465 New Delhi dated Oct. 8-12, 2006 (4 pages).
Philipp: "Charge transfer sensing" Sensor Review vol. 19 No. 2 Dec. 31, 1999 (Dec. 31, 1999) 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy"; dated Sep. 2005 (9 pages).
Smith, Lindsay I., "A tutorial on Principal Components Analysis," dated Feb. 26, 2001 (27 pages).
Stewart M. et al. "Polysilicon TFT technology for active matrix OLED displays" IEEE transactions on electron devices vol. 48 No. 5 May 2001 (7 pages).
Vygranenko et al.: "Stability of indium-oxide thin-film transistors by reactive ion beam assisted deposition"; dated Feb. 2009.
Wang et al.: "Indium oxides by reactive ion beam assisted evaporation: From material study to device application," dated Mar. 2009 (6 pages).
Yi He et al. "Current-Source a-Si:H Thin Film Transistor Circuit for Active-Matrix Organic Light-Emitting Displays" IEEE Electron Device Letters vol. 21 No. 12 Dec. 2000 pp. 590-592.
International Search Report Application No. PCT/IB2013/059074, dated Dec. 18, 2013 (5 pages).

(56) References Cited

OTHER PUBLICATIONS

International Searching Authority Written Opinion Application No. PCT/IB2013/059074, dated Dec. 18, 2013 (8 pages ).
Extended European Search Report Application No. EP 15173106.4 dated Oct. 15, 2013 (8 pages).

* cited by examiner

SYSTEMS AND METHODS OF DISPLAY BRIGHTNESS ADJUSTMENT

CROSS-REFERENCE TO RELATED APPLICATION(S)

This application claims priority to Canadian Patent Application No. 2,886,862, filed Apr. 1, 2015, which is hereby incorporated by reference herein in its entirety.

FIELD OF THE INVENTION

The present disclosure relates to managing of aging and deterioration of light emissive visual display technology, and particularly to systems and methods for display temperature and aging monitoring and management through brightness control for active matrix light emitting diode device (AMOLED) and other emissive displays.

BRIEF SUMMARY

According to a first aspect there is provided a method of adjusting a brightness of an emissive display system including: periodically measuring at least one physical property in at least one area of a display panel generating measurement data; and adjusting the brightness of the display panel with use of the measurement data.

In some embodiments the measurement data comprises measurements of each at least one physical property, the embodiment further providing for: comparing each measurement of each at least one physical property with at least one threshold generating a respective at least one comparison, wherein adjusting the brightness of the display panel is performed with use of the at least one comparison.

Some embodiment further provide for: predicting the future state of at least one physical property with use of the measurement data generating at least one predicted physical property value; and comparing the at least one predicted physical property value with at least one threshold generating a respective at least one comparison, wherein adjusting the brightness of the display panel is performed with use of the at least one comparison.

In some embodiments, adjusting the brightness of the display panel comprises determining a target brightness for the display panel with use of the measurement data, wherein the target brightness falls within at least one acceptable range of brightness.

In some embodiments, adjusting the brightness of the display panel comprises determining a target brightness for the display panel with use of the measurement data, wherein the target brightness falls within at least one acceptable range of brightness.

In some embodiments the at least one physical property comprises a rate of temperature change and the at least one threshold comprises a first threshold rate of temperature change and a second threshold rate of temperature change, wherein adjusting the brightness of the display panel comprises: determining the target brightness to be lower than a current brightness when the at least one comparison indicates that the rate of temperature change is greater than the first threshold rate of temperature change and when the current brightness is greater than a minimum acceptable brightness of said at least one acceptable range of brightness; and determining the target brightness to be higher than the current brightness when the at least one comparison indicates that the rate of temperature change is greater than the second threshold rate of temperature change, and when the current brightness is less than a maximum acceptable brightness of said at least one acceptable range of brightness.

In some embodiments, the at least one physical property comprises a temperature and the at least one threshold comprises a first threshold temperature and a second threshold temperature, wherein adjusting the brightness of the display panel comprises: determining the target brightness to be lower than a current brightness when the at least one comparison indicates that the temperature is greater than the first threshold temperature and when the current brightness is greater than a minimum acceptable brightness of said at least one acceptable range of brightness; and determining the target brightness to be higher than the current brightness when the at least one comparison indicates that the temperature is greater than the second threshold temperature, and when the current brightness is less than a maximum acceptable brightness of said at least one acceptable range of brightness.

In some embodiments, the at least one physical property comprises a rate of temperature change and a temperature and the at least one threshold comprises a threshold rate of temperature change a threshold temperature, wherein adjusting the brightness of the display panel comprises: determining the target brightness to be lower than a current brightness when the at least one comparison indicates that the rate of temperature change is greater than the threshold rate of temperature change and the temperature is greater than the first threshold temperature and when the current brightness is greater than a minimum acceptable brightness of said at least one acceptable range of brightness; and determining the target brightness to be higher than the current brightness when the at least one comparison indicates that at least one of the rate of temperature change is not greater than the threshold rate of temperature change and the temperature is not greater than the second threshold temperature, and when the current brightness is less than a maximum acceptable brightness of said at least one acceptable range of brightness.

In some embodiments, the at least one physical property comprises a rate of temperature change and a temperature, the at least one predicted physical property value comprises a predicted temperature value, and the at least one threshold comprises a first threshold temperature and a second threshold temperature, wherein adjusting the brightness of the display panel comprises: determining the target brightness to be lower than a current brightness when the at least one comparison indicates that the predicted temperature value is greater than the first threshold temperature and when the current brightness is greater than a minimum acceptable brightness of said at least one acceptable range of brightness; and determining the target brightness to be higher than the current brightness when the at least one comparison indicates that the predicted temperature value is not greater than the second threshold temperature, and when the current brightness is less than a maximum acceptable brightness of said at least one acceptable range of brightness.

In some embodiments, the at least one physical property comprises a rate of aging and the at least one threshold comprises a first threshold rate of aging and a second threshold rate of aging, wherein adjusting the brightness of the display panel comprises: determining the target brightness to be lower than a current brightness when the at least one comparison indicates that the rate of aging is greater than the first threshold rate of aging and when the current brightness is greater than a minimum acceptable brightness of said at least one acceptable range of brightness; and determining the target brightness to be higher than the current brightness when the at least one comparison indicates that the rate of aging is greater than the second threshold rate of aging, and when the current brightness is less than a maximum acceptable brightness of said at least one acceptable range of brightness.

In some embodiments, the at least one physical property comprises aging and the at least one threshold comprises a first threshold aging and a second threshold aging, wherein adjusting the brightness of the display panel comprises: determining the target brightness to be lower than a current brightness when the at least one comparison indicates that the aging is greater than the first threshold aging and when the current brightness is greater than a minimum acceptable brightness of said at least one acceptable range of brightness; and determining the target brightness to be higher than the current brightness when the at least one comparison indicates that the aging is greater than the second threshold aging, and when the current brightness is less than a maximum acceptable brightness of said at least one acceptable range of brightness.

In some embodiments, the at least one physical property comprises aging and a rate of aging the at least one threshold comprises a plurality of aging thresholds and a corresponding plurality of threshold aging rates, wherein adjusting the brightness of the display panel comprises: determining the target brightness when the at least one comparison indicates that the aging is greater than the one of the plurality of aging threshold and the rate of aging is greater than the corresponding one of the plurality of threshold aging rates.

According to a second aspect there is provided a display system comprising: a display panel having an array of pixels that each include a drive transistor and a light emitting device, multiple select lines coupled to said array for delivering signals that select when each pixel is to be driven, multiple data lines for delivering drive signals to the selected pixels, and multiple monitor lines for conveying signals from each pixel; and a monitor system for periodically measuring at least one physical property in at least one area of the display with use of signals over the monitor lines to pixels of the at least one area generating measurement data; a memory store for storing the measurement data; and a controller adapted to adjust the brightness of the display panel with use of the measurement data.

In some embodiments, the measurement data comprises measurements of each at least one physical property, the controller further adapted to: compare each measurement of each at least one physical property with at least one threshold generating a respective at least one comparison, wherein the controller is adapted to adjust the brightness of the display panel with use of the at least one comparison.

In some embodiments, the controller is further adapted to: predict the future state of at least one physical property with use of the measurement data generating at least one predicted physical property value; and compare the at least one predicted physical property value with at least one threshold generating a respective at least one comparison, wherein the controller is adapted to adjust the brightness of the display panel with use of the at least one comparison.

In some embodiments, the controller is adapted to adjust the brightness of the display panel by determining a target brightness for the display panel with use of the measurement data, wherein the target brightness falls within at least one acceptable range of brightness.

In some embodiments, the controller is adapted to adjust the brightness of the display panel by determining a target brightness for the display panel with use of the measurement data, wherein the target brightness falls within at least one acceptable range of brightness.

In some embodiments, the at least one physical property comprises a rate of temperature change and the at least one threshold comprises a first threshold rate of temperature change and a second threshold rate of temperature change, wherein the controller is adapted to adjust the brightness of the display panel by: determining the target brightness to be lower than a current brightness when the at least one comparison indicates that the rate of temperature change is greater than the first threshold rate of temperature change and when the current brightness is greater than a minimum acceptable brightness of said at least one acceptable range of brightness; and determining the target brightness to be higher than the current brightness when the at least one comparison indicates that the rate of temperature change is less than the second threshold rate of temperature change, and when the current brightness is less than a maximum acceptable brightness of said at least one acceptable range of brightness.

In some embodiments, the at least one physical property comprises a temperature and the at least one threshold comprises a first threshold temperature and a second threshold temperature, wherein the controller is adapted to adjust the brightness of the display panel by: determining the target brightness to be lower than a current brightness when the at least one comparison indicates that the temperature is greater than the first threshold temperature and when the current brightness is greater than a minimum acceptable brightness of said at least one acceptable range of brightness; and determining the target brightness to be higher than the current brightness when the at least one comparison indicates that the temperature is less than the second threshold temperature, and when the current brightness is less than a maximum acceptable brightness of said at least one acceptable range of brightness.

In some embodiments, the at least one physical property comprises a rate of temperature change and a temperature and the at least one threshold comprises a threshold rate of temperature change a threshold temperature, wherein the controller is adapted to adjust the brightness of the display panel by: determining the target brightness to be lower than a current brightness when the at least one comparison indicates that the rate of temperature change is greater than the threshold rate of temperature change and the temperature is greater than the threshold temperature and when the current brightness is greater than a minimum acceptable brightness of said at least one acceptable range of brightness; and determining the target brightness to be higher than the current brightness when the at least one comparison indicates that at least one of the rate of temperature change is not greater than the threshold rate of temperature change and the temperature is not greater than the threshold temperature, and when the current brightness is less than a maximum acceptable brightness of said at least one acceptable range of brightness.

In some embodiments, the at least one physical property comprises a rate of temperature change and a temperature, the at least one predicted physical property value comprises a predicted temperature value, and the at least one threshold comprises a first threshold temperature and a second threshold temperature, wherein the controller is adapted to adjust the brightness of the display panel by: determining the target brightness to be lower than a current brightness when the at least one comparison indicates that the predicted temperature value is greater than the first threshold temperature and when the current brightness is greater than a minimum acceptable brightness of said at least one acceptable range of brightness; and determining the target brightness to be higher than the current brightness when the at least one comparison indicates that the predicted temperature value is less than the second threshold temperature, and when the current brightness is less than a maximum acceptable brightness of said at least one acceptable range of brightness.

In some embodiments, the at least one physical property comprises a rate of aging and the at least one threshold comprises a first threshold rate of aging and a second threshold rate of aging, wherein the controller is adapted to adjust the brightness of the display panel by: determining the target brightness to be lower than a current brightness when the at least one comparison indicates that the rate of aging is greater than the first threshold rate of aging and when the current brightness is greater than a minimum acceptable brightness of said at least one acceptable range of brightness; and determining the target brightness to be higher than the current brightness when the at least one comparison indicates that the rate of aging is less than the second threshold rate of aging, and when the current brightness is less than a maximum acceptable brightness of said at least one acceptable range of brightness.

In some embodiments, the at least one physical property comprises aging and the at least one threshold comprises a first threshold aging and a second threshold aging, wherein the controller is adapted to adjust the brightness of the display panel by: determining the target brightness to be lower than a current brightness when the at least one comparison indicates that the aging is greater than the first threshold aging and when the current brightness is greater than a minimum acceptable brightness of said at least one acceptable range of brightness; and determining the target brightness to be higher than the current brightness when the at least one comparison indicates that the aging is greater than the second threshold aging, and when the current brightness is less than a maximum acceptable brightness of said at least one acceptable range of brightness.

In some embodiments, the at least one physical property comprises aging and a rate of aging the at least one threshold comprises a plurality of aging thresholds and a corresponding plurality of threshold aging rates, wherein the controller is adapted to adjust the brightness of the display panel by determining the target brightness when the at least one comparison indicates that the aging is greater than the one of the plurality of aging threshold and the rate of aging is greater than the corresponding one of the plurality of threshold aging rates.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the disclosure will become apparent upon reading the following detailed description and upon reference to the drawings.

Figure 1:
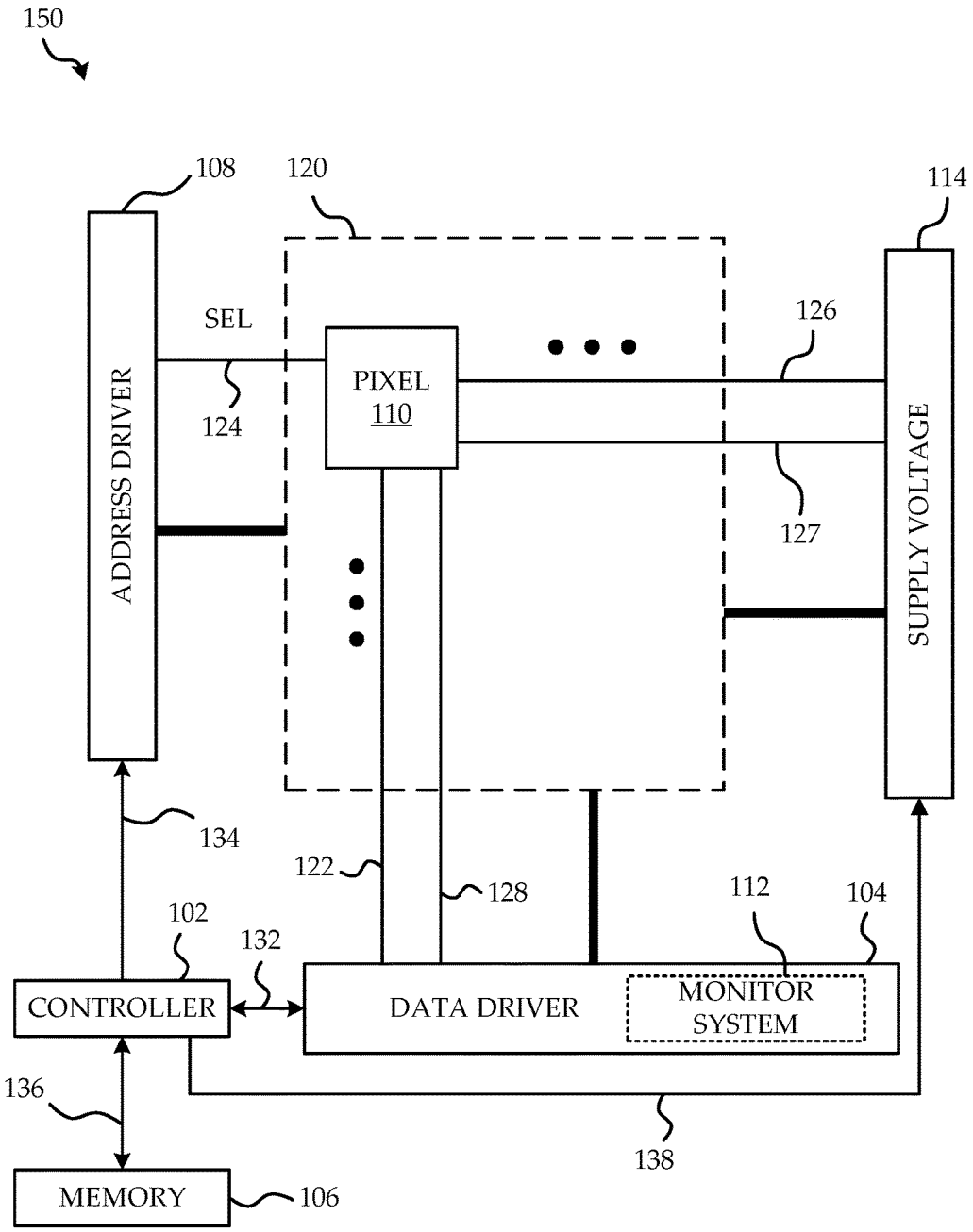
FIG. 1 illustrates an example display system in which management of temperature and aging though brightness control is implemented.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of an invention as defined by the appended claims.

DETAILED DESCRIPTION

Many modern display technologies suffer from an inherent performance-degradation trade-off. Image quality and performance is improved with higher display brightness, however, higher display brightness generally causes greater rates of degradation and aging of the display, compromising its ability to produce images. In emissive displays, higher brightness causes a temperature increase which can rapidly cause faster aging.

The systems and methods disclosed below address this dilemma through monitoring of temperature and aging and the management of display brightness to simultaneously address image quality while preventing or slowing the self-destruction of the display.

While the embodiments described herein will be in the context of AMOLED displays it should be understood that the temperature and aging monitoring and management through display brightness control described herein are applicable to any other display comprising pixels subject to aging and deterioration due to brightness and/or temperature, including but not limited to light emitting diode displays (LED), electroluminescent displays (ELD), organic light emitting diode displays (OLED), plasma display panels (PSP), among other displays.

It should be understood that the embodiments described herein pertain to systems and methods of temperature and aging management through display brightness control and do not limit the display technology underlying their operation and the operation of the displays in which they are implemented. The systems and methods described herein are applicable to any number of various types and implementations of various visual display technologies.

FIG. 1 is a diagram of an example display system 150 implementing the methods described further below. The display system 150 includes a display panel 120, an address driver 108, a data driver 104, a controller 102, and a memory storage 106.

The display panel 120 includes an array of pixels 110 (only one explicitly shown) arranged in rows and columns. Each of the pixels 110 is individually programmable to emit light with individually programmable luminance values. The controller 102 receives digital data indicative of information to be displayed on the display panel 120. The controller 102 sends signals 132 to the data driver 104 and scheduling signals 134 to the address driver 108 to drive the pixels 110 in the display panel 120 to display the information indicated. The plurality of pixels 110 of the display panel 120 thus comprise a display array or display screen adapted to dynamically display information according to the input digital data received by the controller 102. The display screen and various subsets of its pixels define "display areas" which may be used for monitoring and managing display brightness. The display screen can display images and streams of video information from data received by the controller 102. The supply voltage 114 provides a constant power voltage or can serve as an adjustable voltage supply that is controlled by signals from the controller 102. The display system 150 can also incorporate features from a current source or sink (not shown) to provide biasing currents to the pixels 110 in the display panel 120 to thereby decrease programming time for the pixels 110.

For illustrative purposes, only one pixel 110 is explicitly shown in the display system 150 in FIG. 1. It is understood that the display system 150 is implemented with a display screen that includes an array of a plurality of pixels, such as the pixel 110, and that the display screen is not limited to a particular number of rows and columns of pixels. For example, the display system 150 can be implemented with a display screen with a number of rows and columns of pixels commonly available in displays for mobile devices, monitor-based devices, and/or projection-devices.

The pixel 110 is operated by a driving circuit or pixel circuit that generally includes a driving transistor and a light emitting device. Hereinafter the pixel 110 may refer to the pixel circuit. The light emitting device can optionally be an organic light emitting diode, but implementations of the present disclosure apply to pixel circuits having other electroluminescence devices, including current-driven light emitting devices and those listed above. The driving transistor in the pixel 110 can optionally be an n-type or p-type amorphous silicon thin-film transistor, but implementations of the present disclosure are not limited to pixel circuits having a particular polarity of transistor or only to pixel circuits having thin-film transistors. The pixel circuit 110 can also include a storage capacitor for storing programming information and allowing the pixel circuit 110 to drive the light emitting device after being addressed. Thus, the display panel 120 can be an active matrix display array.

As illustrated in FIG. 1, the pixel 110 illustrated as the top-left pixel in the display panel 120 is coupled to a select line 124, a supply line 126, a data line 122, and a monitor line 128. A read line may also be included for controlling connections to the monitor line. In one implementation, the supply voltage 114 can also provide a second supply line to the pixel 110. For example, each pixel can be coupled to a first supply line 126 charged with Vdd and a second supply line 127 coupled with Vss, and the pixel circuits 110 can be situated between the first and second supply lines to facilitate driving current between the two supply lines during an emission phase of the pixel circuit. It is to be understood that each of the pixels 110 in the pixel array of the display 120 is coupled to appropriate select lines, supply lines, data lines, and monitor lines. It is noted that aspects of the present disclosure apply to pixels having additional connections, such as connections to additional select lines, and to pixels having fewer connections.

With reference to the pixel 110 of the display panel 120, the select line 124 is provided by the address driver 108, and can be utilized to enable, for example, a programming operation of the pixel 110 by activating a switch or transistor to allow the data line 122 to program the pixel 110. The data line 122 conveys programming information from the data driver 104 to the pixel 110. For example, the data line 122 can be utilized to apply a programming voltage or a programming current to the pixel 110 in order to program the pixel 110 to emit a desired amount of luminance. The programming voltage (or programming current) supplied by the data driver 104 via the data line 122 is a voltage (or current) appropriate to cause the pixel 110 to emit light with a desired amount of luminance according to the digital data received by the controller 102. The programming voltage (or programming current) can be applied to the pixel 110 during a programming operation of the pixel 110 so as to charge a storage device within the pixel 110, such as a storage capacitor, thereby enabling the pixel 110 to emit light with the desired amount of luminance during an emission operation following the programming operation. For example, the storage device in the pixel 110 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in the pixel 110, the driving current that is conveyed through the light emitting device by the driving transistor during the emission operation of the pixel 110 is a current that is supplied by the first supply line 126 and is drained to a second supply line 127. The first supply line 126 and the second supply line 127 are coupled to the voltage supply 114. The first supply line 126 can provide a positive supply voltage (e.g., the voltage commonly referred to in circuit design as "Vdd") and the second supply line 127 can provide a negative supply voltage (e.g., the voltage commonly referred to in circuit design as "Vss"). Implementations of the present disclosure can be realized where one or the other of the supply lines (e.g., the supply line 127) is fixed at a ground voltage or at another reference voltage.

The display system 150 also includes a monitoring system 112. With reference again to the pixel 110 of the display panel 120, the monitor line 128 connects the pixel 110 to the monitoring system 112. The monitoring system 12 can be integrated with the data driver 104, or can be a separate stand-alone system. In particular, the monitoring system 112 can optionally be implemented by monitoring the current and/or voltage of the data line 122 during a monitoring operation of the pixel 110, and the monitor line 128 can be entirely omitted. The monitor line 128 allows the monitoring system 112 to measure a current or voltage associated with the pixel 110 and thereby extract information indicative of a degradation or aging of the pixel 110 or indicative of a temperature of the pixel 110. In some embodiment, display panel 120 includes temperature sensing circuitry devoted to sensing temperature implemented in the pixels 110, while in other embodiments, the pixels 110 comprise circuitry which participates in both sensing temperature and driving the pixels. For example, the monitoring system 112 can extract, via the monitor line 128, a current flowing through the driving transistor within the pixel 110 and thereby determine, based on the measured current and based on the voltages applied to the driving transistor during the measurement, a threshold voltage of the driving transistor or a shift thereof.

The monitoring system 112 can also extract an operating voltage of the light emitting device (e.g., a voltage drop across the light emitting device while the light emitting device is operating to emit light). The monitoring system 112 can then communicate signals 132 to the controller 102 and/or the memory 106 to allow the display system 150 to store the extracted aging information in the memory 106. During subsequent programming and/or emission operations of the pixel 110, the aging information is retrieved from the memory 106 by the controller 102 via memory signals 136, and the controller 102 then compensates for the extracted degradation information in subsequent programming and/or emission operations of the pixel 110. For example, once the degradation information is extracted, the programming information conveyed to the pixel 110 via the data line 122 can be appropriately adjusted during a subsequent programming operation of the pixel 110 such that the pixel 110 emits light with a desired amount of luminance that is independent of the degradation of the pixel 110. In an example, an increase in the threshold voltage of the driving transistor within the pixel 110 can be compensated for by appropriately increasing the programming voltage applied to the pixel 110.

Over and above calibration, which can be implemented on a pixel by pixel basis, an overall brightness of the display panel 120 is controlled in response to monitored temperature and aging, in order to manage and control temperatures and aging of the display. In embodiments that follow, typically a controller 102 of the display system 150 directs the monitor system 112 to take measurements of temperature and aging, saves to and retrieves from the memory store 106 data indicative of temperature and aging and perform the various processes to determine how management of the overall brightness of the display is to occur.

Figure 2:
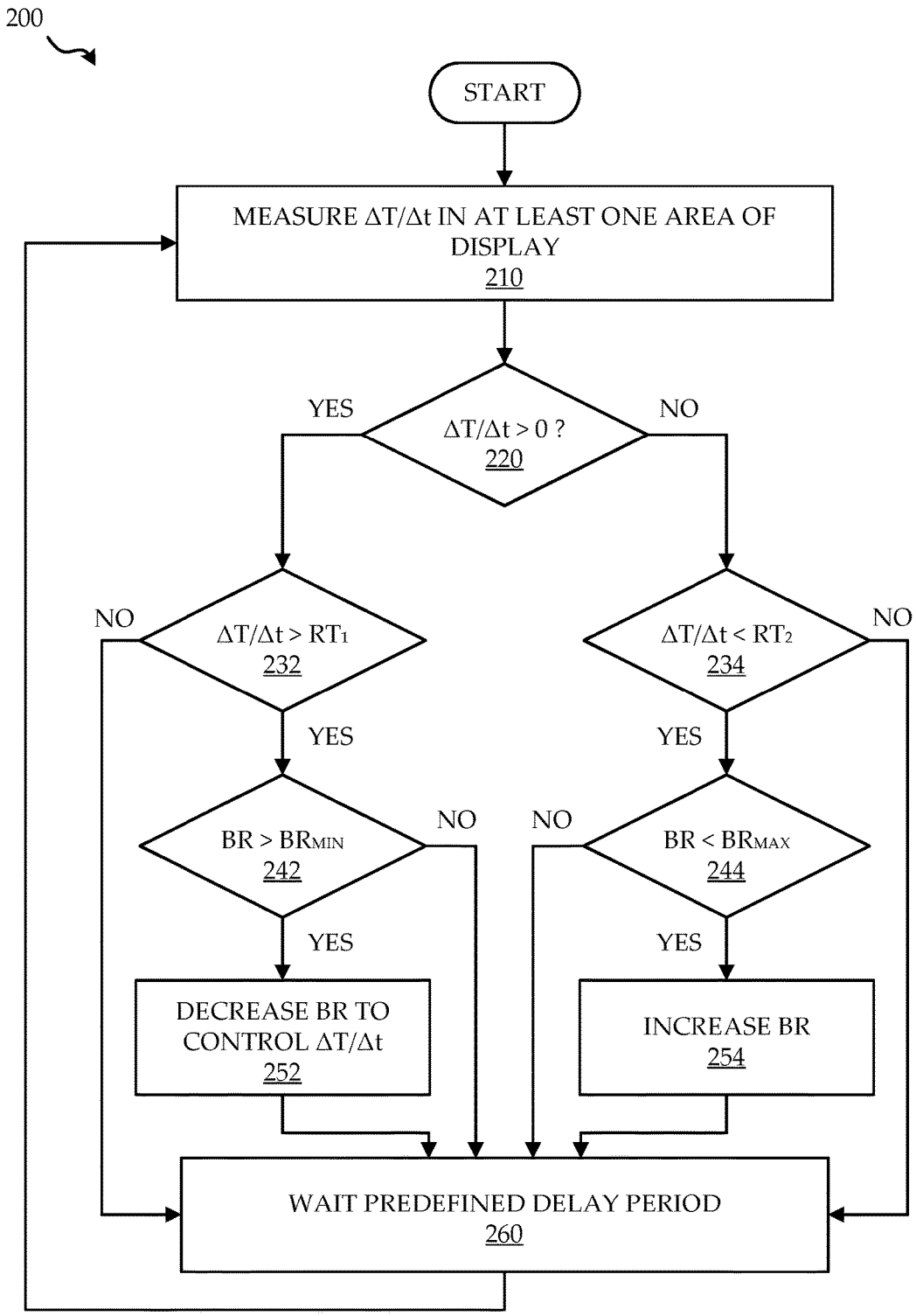
FIG. 2 illustrates a method employed by the system for management of temperature stability, aging, and optimal brightness through brightness control.

Referring to FIG. 2, a method employed by the display system 150 for management of temperature stability, aging, and optimal brightness through brightness control will now be described. The method 200 controls display aging and temperature by adjusting the display brightness based on the rate of change in measured or estimated temperature $\Delta T/\Delta t$ of at least one display area. The temperature change $\Delta T/\Delta t$ of at least one area of the display panel 120 is measured or estimated 210 and the display brightness is controlled by the rate of change in the temperature as follows. If the rate of increase in the temperature is faster than a defined threshold rate $RT_1$, i.e. if $\Delta T/\Delta t>0$ and $\Delta T/\Delta t>RT_1$, 220 232 the display brightness BR is adjusted 252 to stabilize the display temperature and in this particular embodiment is reduced 252 when the brightness BR is above a predefined minimum brightness $BR_{MIN}$ 242. If the measured temperature is decreasing and optionally below a negative threshold rate $RT_2$ 234 and there is headroom left for increasing the display brightness i.e. the brightness BR is less than a defined maximum brightness $BR_{MAX}$ 244, the display brightness can increase until the temperature stabilizes. In general the display brightness is controlled to stay within a defined minimum brightness $BR_{MIN}$ and a defined maximum brightness $BR_{MAX}$. After adjustment of the brightness or if the rate of temperature change is between the thresholds (i.e. $RT_2<\Delta T/\Delta t<RT_1$) or if the brightness cannot be increased 244 or decreased 242 due to the defined maximum or minimum brightness threshold having been met, then the system waits for a predefined waiting period 260 before making a subsequent temperature measurement or estimate 210.

The temperature changing rate $\Delta T/\Delta t$ of more areas in the display panel 120 can be measured or estimated (also a temperature changing rate profile of the entire display panel 120 can be created) and different methods can be used for making decisions in the flowchart. It should be noted that measuring the temperature changing rate $\Delta T/\Delta t$ can be achieved by measuring the temperature T at various discrete times or continuously over time or alternatively by monitoring some quantity or property which directly varies with $\Delta T/\Delta t$.

In one case, if one point or pixel of the display panel 120 has a temperature-changing rate $\Delta T/\Delta t$ higher or lower than a threshold value, proper steps can be taken as described. In another case, the temperature-changing rate $\Delta T/\Delta t$ of an accumulative area (e.g., number of pixels) larger than a predefined size should satisfy the condition before taking the proper steps. The multi-point (or area) measurement (or estimation) can be applied to all the methods described in this document and known decision making mechanisms can be utilized in the multi-point measurement (or estimation) in cooperation with the methods herein described.

Figure 3:
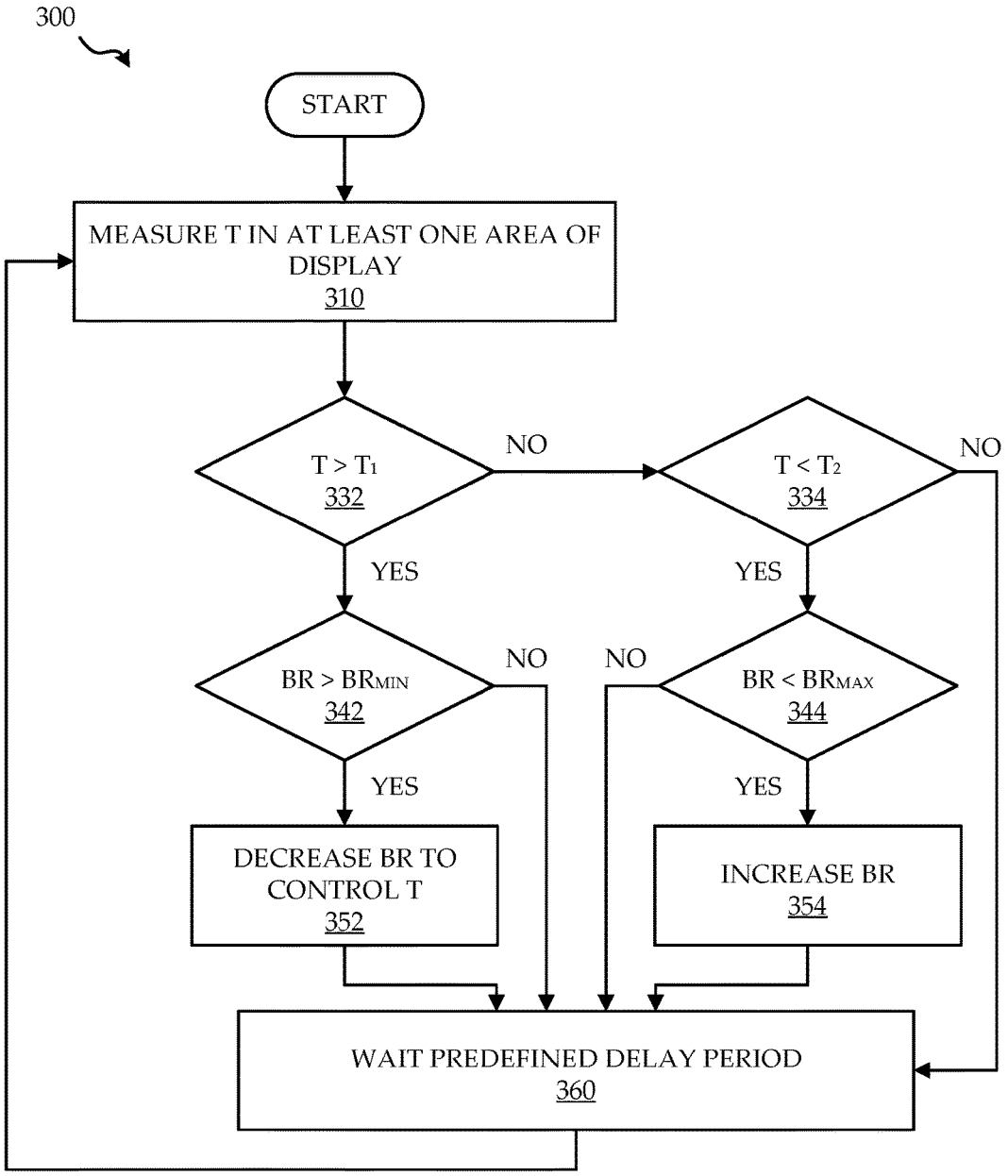
FIG. 3 illustrates a method employed by the system for management of absolute temperature, aging, and optimal brightness through brightness control.

Referring now to FIG. 3, a method employed by the display system 150 for management of absolute temperature, aging, and optimal brightness through brightness control, will now be described. Here the display system 150 utilizes a method 300 of controlling display aging and temperature by adjusting the display brightness based on measured or estimated absolute temperatures T of at least one display area. The temperature T of at least one area of the display panel 120 is measured or estimated 310 and said temperature value controls the brightness of the display as follows. If the measured display temperature T is higher than a threshold $T_1$ 332, the display brightness is dropped 352 until the temperature T drops below the threshold $T_1$ or the brightness BR hits the minimum allowable value $BR_{MIN}$ 342. If the temperature T is below the threshold (optionally a second threshold $T_2$) 334, the brightness can increase 352 until the temperature is higher than a given threshold ($T_1$ or $T_2$) or the brightness hits the maximum allowable value $BR_{MAX}$ 344. After adjustment of the brightness, or if the temperature T is between the thresholds (i.e., $T_2<T<T_1$) or if the brightness cannot be increased 344 or decreased 342 due to the defined maximum or minimum brightness threshold having been met, then the system waits for a predefined waiting period 360 before making a subsequent temperature measurement or estimate 310.

In all the methods in this document, different threshold ranges and different adjustment mechanism can be used for each region. For example, if the temperature is really high the decrease adjustment to BR 352 can be performed with a larger correction factor to reduce the time required to bring the temperature or aging within a controlled range.

Figure 4:
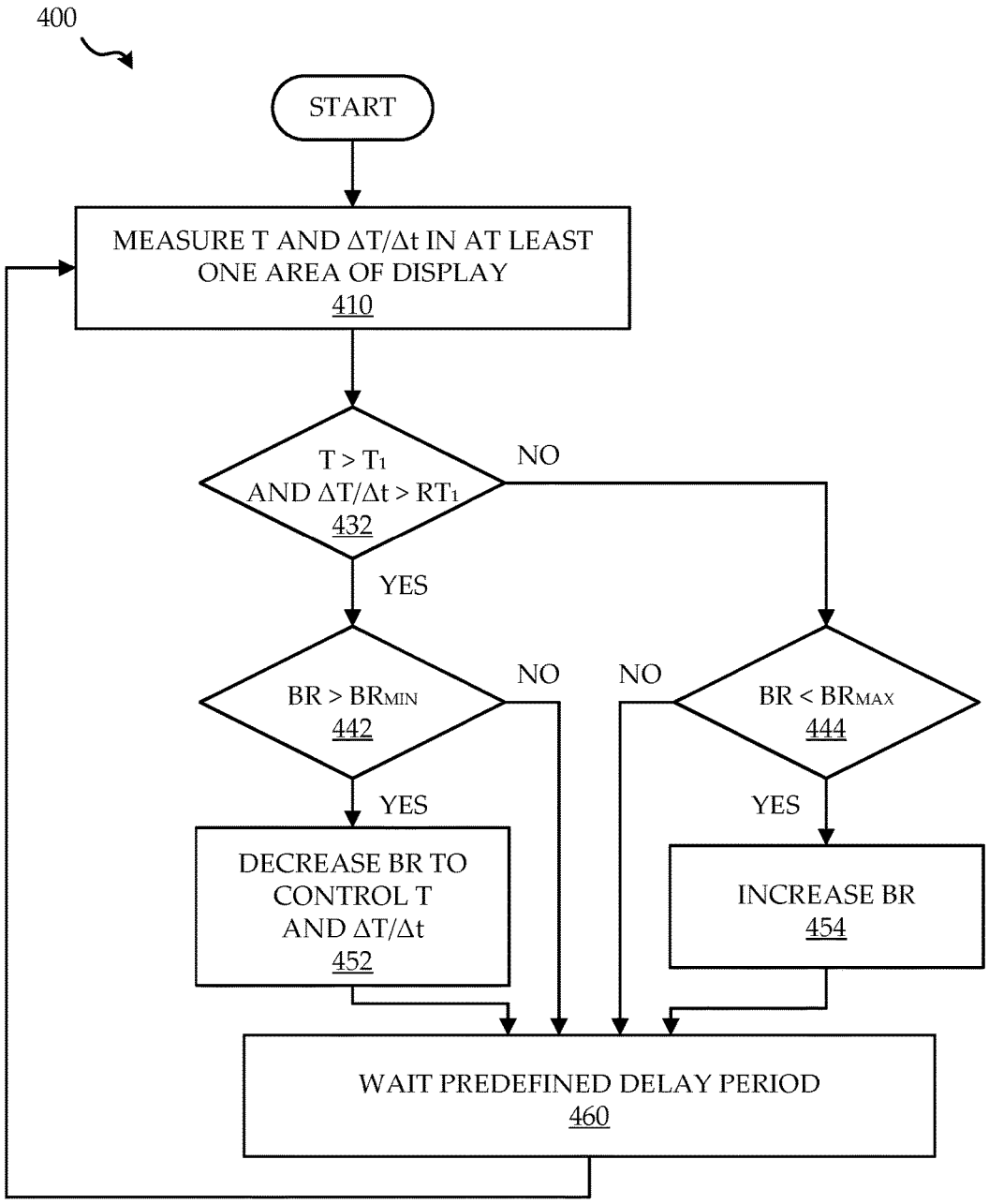
FIG. 4 illustrates a method employed by the system for management of temperature stability, absolute temperature, aging, and optimal brightness through brightness control.

Referring to FIG. 4, a method employed by the display system 150 for management of temperature stability, absolute temperature, aging, and optimal brightness through brightness control will now be described.

Here the display system 150 utilizes a method 400 for controlling display aging or temperature by adjusting the display brightness based on measured or estimated temperature T and the measured or estimated rate of change in the temperature $\Delta T/\Delta t$ 410 of at least one area of the display panel 120. In one approach if the absolute temperature is higher than a threshold $T_1$ and the rate of change $\Delta T/\Delta t$ indicates that the temperature will stay at existing levels or increase further or the rate of temperature reduction is slower than a threshold (this threshold can be a given parameters or can be calculated based on maximum allowable time for display operation at high temperature), in other words, if $\Delta T/\Delta t$ is greater than some threshold rate $RT_1$ 432 the display brightness will be reduced 452 until the temperature is stabilized (and/or goes below a threshold level) or the display brightness hits the minimum allowable brightness 442. If on the other hand $T>T1$ and $\Delta T/\Delta t>RT_1$ is not the case, then staying within the defined maximum brightness threshold $BR_{MAX}$ 444, the brightness is optimized through increases 454. After adjustment of the brightness, or if the brightness cannot be increased 444 or decreased 442 due to the defined maximum or minimum brightness threshold having been met, then the system waits for a predefined waiting period 460 before making a subsequent temperature measurement or estimate 410.

Figure 5:
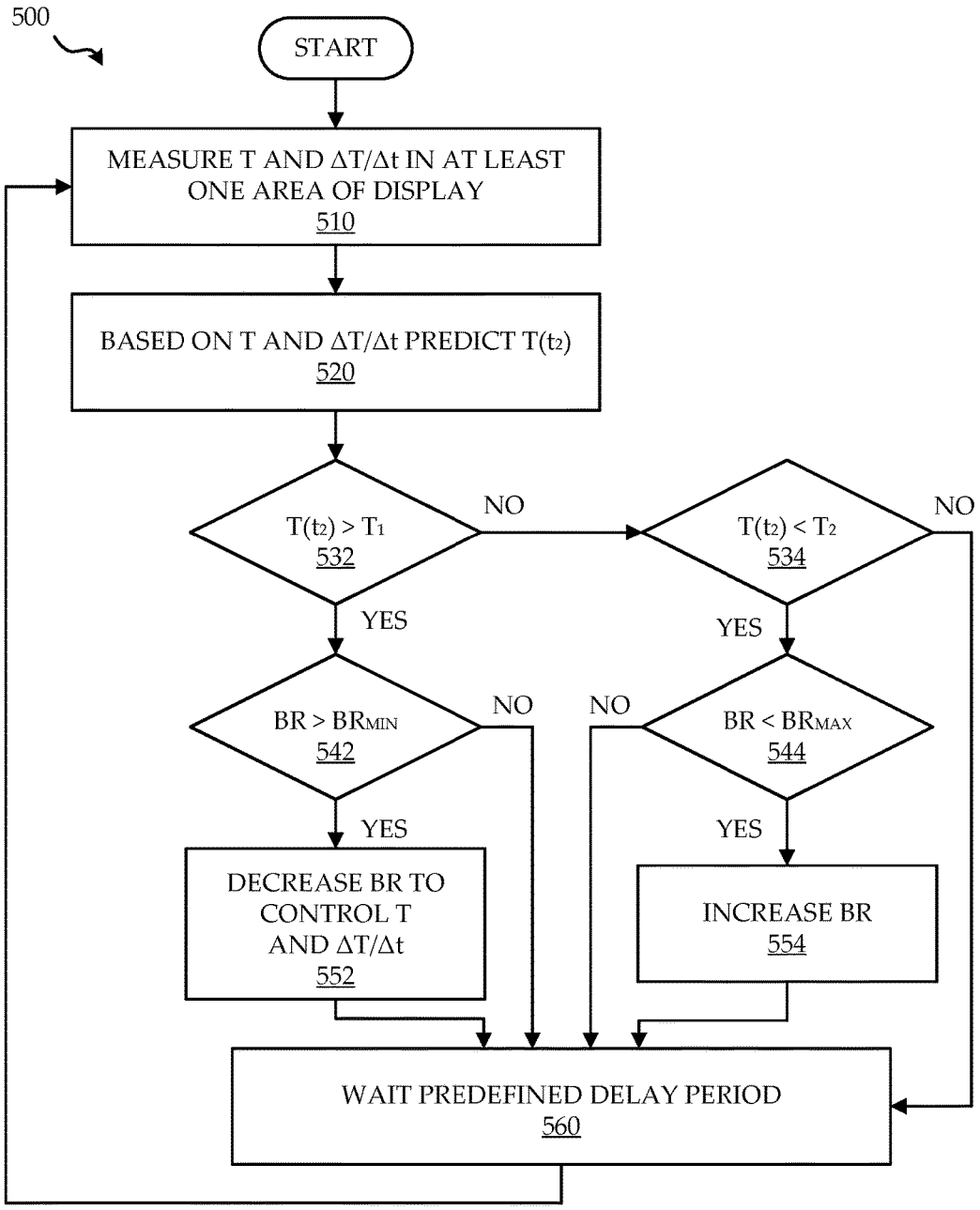
FIG. 5 illustrates a method employed by the system for management of optimal brightness and aging, avoiding overheating through predictive analysis and brightness control.

Referring also to FIG. 5, a method employed by the display system 150 for management of aging and optimal brightness while avoiding overheating through predictive analysis and brightness control will now be described. Here, the display system 150 implements a method 500 to adjust the display brightness 552 to eliminate overheating if the measured rate of change and absolute value of temperature 510 indicates 520 that the display temperature will pass a given threshold $T_1$ 532. In other words, if the brightness BR is smaller than a minimum allowable brightness $BR_{MIN}$ 542 and temperature absolute value T and its rate of change $\Delta T/\Delta t$ shows 520 that the temperature will (for example at time $t_2$) be greater than a threshold $T_1$ the brightness can be decreased 552 to avoid the risk of overheating. In a similar manner, to optimize brightness as circumstances allow, if the brightness BR is smaller than a maximum allowable brightness $BR_{MAX}$ 544 and temperature absolute value T and its rate of change $\Delta T/\Delta t$ shows 520 that the temperature will (at time $t_2$) be lower than a threshold $T_2$ 532 the brightness can be increased 554 to improve the image quality without the risk of overheating. After adjustment of the brightness, or if the temperature $T(t_2)$ is predicted to fall between the thresholds (i.e. $T_2<T(t_2)<T_1$) or if the brightness cannot be increased 554 or decreased 552 due to the defined maximum or minimum brightness thresholds having been met, then the system waits for a predefined waiting period 560 before making a subsequent temperature measurement or estimate 510.

Figure 6:
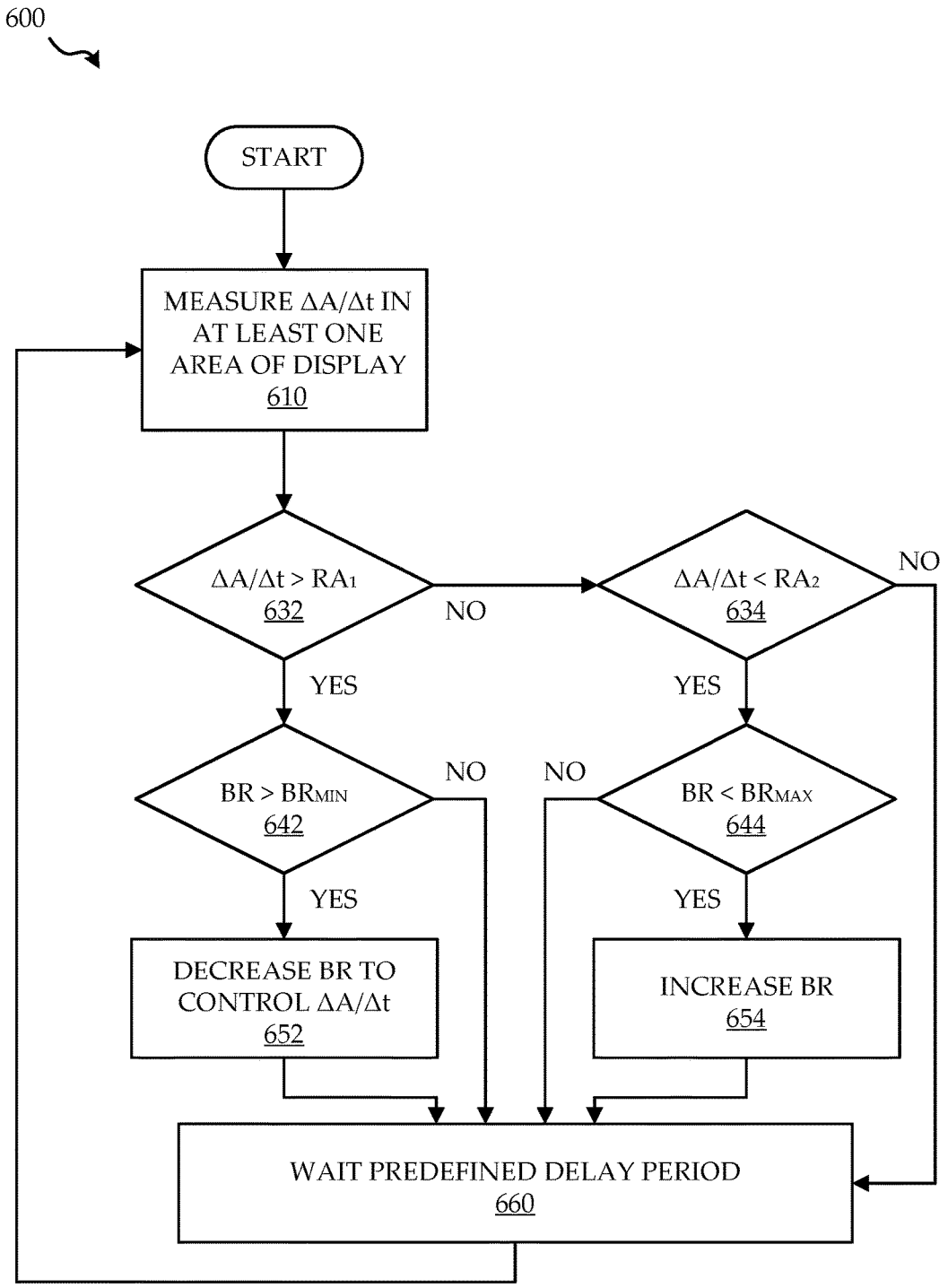
FIG. 6 illustrates a method employed by the system for management of the aging rate and optimal brightness through brightness control.

Referring to FIG. 6 a method employed by the display system 150 for management of the aging rate and optimal brightness through brightness control will now be described. Here, the display system 150 utilizes a method 600 for controlling display aging by adjusting the display brightness based on the rate of change in measured or estimated aging $\Delta A/\Delta t$ of at least one display area. The aging rate $\Delta A/\Delta t$ of at least one area of the display panel 120 is measured or estimated 610 and the display brightness is controlled by the rate of said aging as follows. If the aging rate $\Delta A/\Delta t$ is faster than a defined threshold rate $RA_1$ 632, the display brightness BR is adjusted 652 to stabilize the display aging. In other words if $\Delta A/\Delta t$ is greater than the threshold rate $RA_1$ 632 the display brightness will be reduced 652 towards values which will stabilize the aging rate if the display brightness is above the minimum allowable brightness 642 such that it can be reduced. If the measured aging rate $\Delta A/\Delta t$ is lower than a threshold rate $RA_2$ 634 and there is headroom left for increasing the display brightness or the brightness BR is less than a defined maximum brightness $BR_{MAX}$ 644, the display brightness can increase 654 until the display-aging rate is within the defined thresholds. After adjustment of the brightness or if the rate of aging is between the thresholds (i.e., $RA_2<\Delta A/\Delta t<RA_1$) or if the brightness cannot be increased 644 or decreased 642 due to the defined maximum or minimum brightness threshold having been met, then the system waits for a predefined waiting period 660 before making a subsequent temperature measurement or estimate 610.

Figure 7:
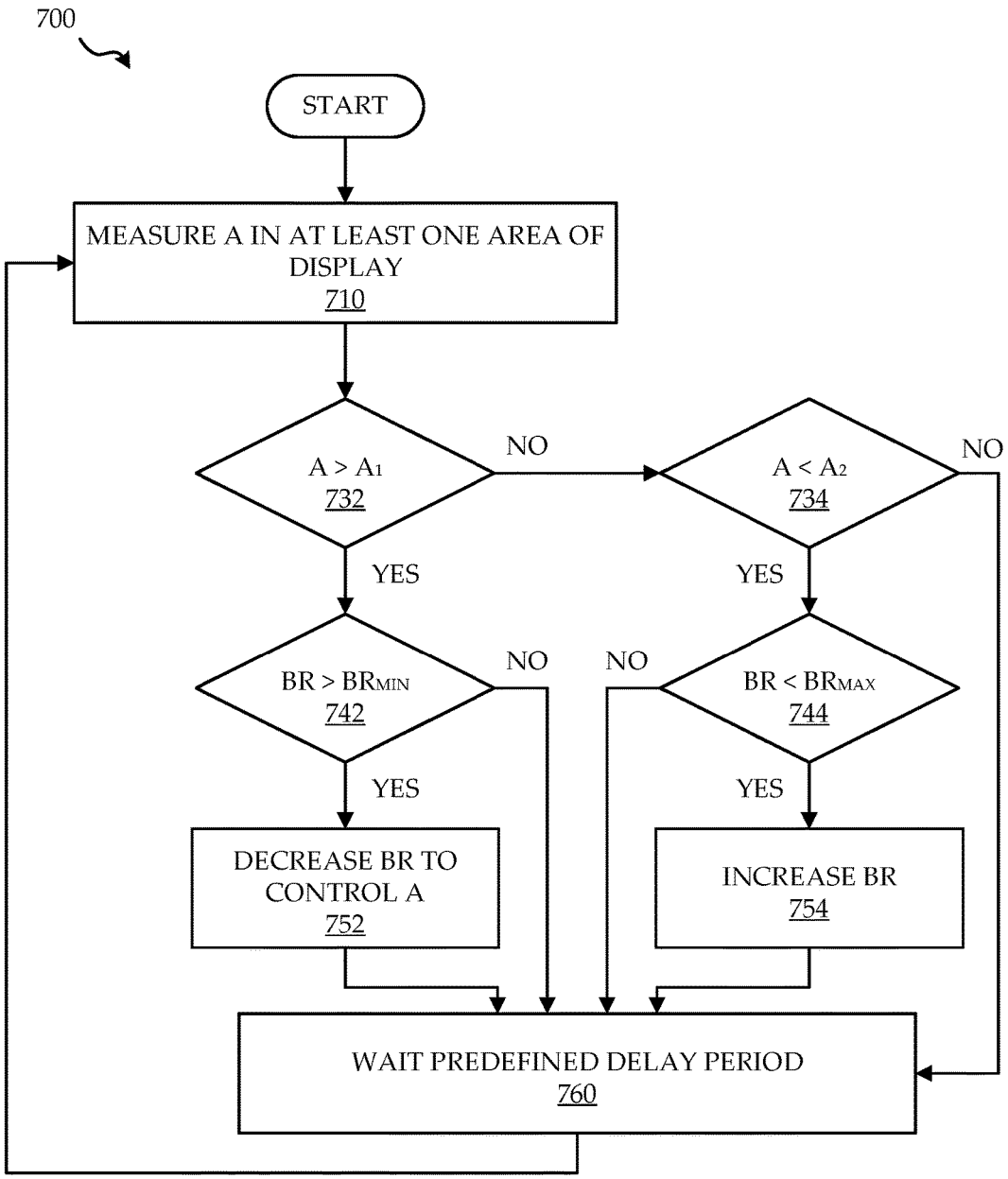
FIG. 7 illustrates a method employed by the system for management of absolute aging and optimal brightness through brightness control.

FIG. 7 illustrates an equivalent method performed by the display system 150 for management of absolute aging. Here, the display system 150 utilizes a method 700 for controlling display aging by adjusting the display brightness based on the measured or estimated aging A of at least one display area. The aging A of at least one area of the display panel 120 is measured or estimated 610 and the display brightness is controlled by the measured aging as follows. If the aging A is beyond a defined threshold $A_1$ 732, the display brightness BR is adjusted (here reduced) 752 if the display brightness BR is above the minimum allowable brightness $BR_{MIN}$ 742. If the measured aging A is less than a threshold $A_2$ 734 and there is headroom left for increasing the display brightness or the brightness BR is less than a defined maximum brightness $BR_{MAX}$ 744, the display brightness can increase 754 until the display-aging is within the defined thresholds. After adjustment of the brightness or if the aging is between the thresholds (i.e., $A_2<A<A_1$) or if the brightness cannot be increased 744 or decreased 742 due to the defined maximum or minimum brightness threshold having been met, then the system waits for a predefined waiting period 760 before making a subsequent temperature measurement or estimate 710.

It should be noted that measuring the aging rate $\Delta A/\Delta t$ can be achieved by measuring the aging A at various discrete times or continuously over time or alternatively by monitoring some quantity or property which directly varies with $\Delta A/\Delta t$, and that measuring aging can be achieved by measuring various properties of the display indicative of aging, calculating aging from various measured properties which are together indicative of aging, and with possible use of historical or saved data stored for retrieval and periodic calculation of the aging.

Figure 8:
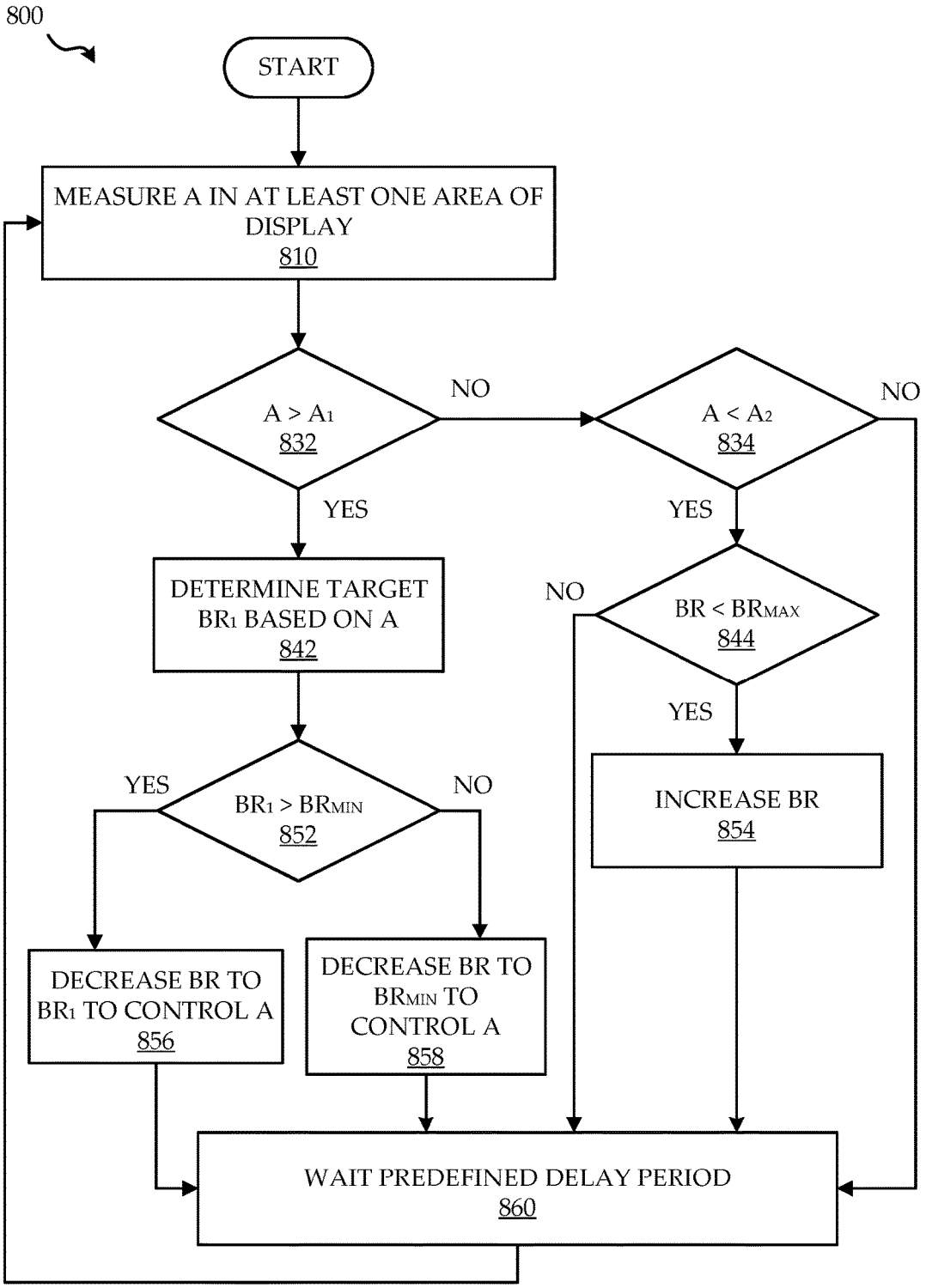
FIG. 8 illustrates another method employed by the system for management of absolute aging and optimal brightness through brightness control.

Referring to FIG. 8, another method employed by the display system 150 for management of absolute aging and optimal brightness through brightness control will now be described. Here, the system 150 utilizes a method 800 for controlling display aging by adjusting the display brightness based on measured or estimated aging A of at least one display area as follows. The aging A of at least one area of the display panel 120 is measured or estimated 810, and the aging value controls the brightness of the display, as follows. If the measured display aging A is higher than a threshold $A_1$ 832, the display brightness is dropped based on a predefined function which determines a target brightness $BR_1$ 842. The function uses any combination of the aging value, the number of pixels where the aging value is higher than the threshold, the display lifetime, display setting parameters, and other empirical parameters. In one case, the display aging is converted to display brightness. The aging rate required to meet the display lifetime is calculated. Here one easy method is to subtract the 50% by calculated brightness loss and divide it over the remaining lifetime requirement. Based on user profile information, the brightness that can achieve the remaining of display lifetime is calculated, and chosen as the current target brightness $BR_1$. In one case, the calculated brightness $BR_1$ can be compared with a minimum brightness $BR_{MIN}$ setting 852, and the higher of two will be used as new display brightness 856, 858. To optimize brightness as circumstances allow, if the brightness BR is smaller than a maximum allowable brightness $BR_{MAX}$ 844 and the aging value A is lower than a threshold $A_2$ 834 the brightness can be increased 854 to improve the image quality under conditions of acceptable aging. After adjustment of the brightness or if the aging is between the thresholds (i.e. $A_2<A<A_1$) or if the brightness cannot be increased 844 due to the defined maximum or minimum brightness threshold having been met, then the system waits for a predefined waiting period 860 before making a subsequent temperature measurement or estimate 810.

Figure 9:
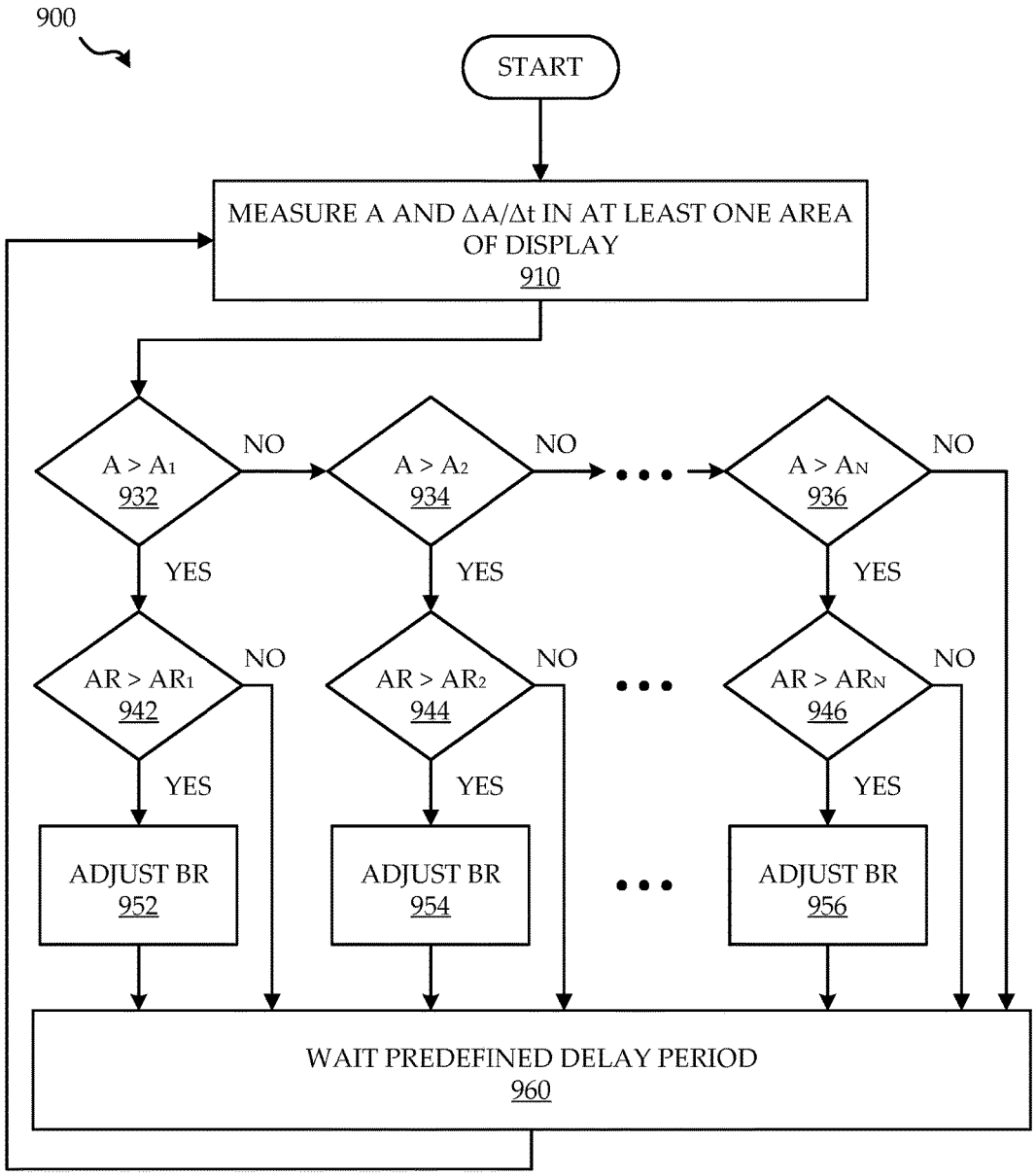
FIG. 9 illustrates a further method employed by the system for management of absolute aging and optimal brightness through brightness control.

Referring to FIG. 9, a further method employed by the display system 150 for management of absolute aging and optimal brightness through brightness control will now be described. Here, the system 150 utilizes a method for controlling display aging by adjusting the display brightness based on measured or estimated aging A and the rate of aging $\Delta A/\Delta t$ of at least one area 910 as follows. In one approach the function to adjust the display brightness is a function of both absolute aging value A and rate of aging $\Delta A/\Delta t$ and associated thresholds $A_1$ and $AR_1$ 932 942. In one case, the brightness can be a set 952 of linear functions within different regions which are separated by threshold values for aging ($A_1, A_2, \ldots A_N$) and the rate of aging ($AR_1, AR_2, \ldots AR_3$). Within each region shown as 1, 2, up to N, the absolute aging A is compared 932, 934, 936 with a threshold for the region ($A_1, A_2, \ldots A_N$) and the aging rate AR is compared 942, 944, 946 with a threshold for the region ($AR_1, AR_2, \ldots AR_N$), and if both thresholds are exceeded, the brightness BR is adjusted 952, 954, 956. If none of the threshold tests are not met, or after adjustment of brightness BR, the system waits for a predefined waiting period 960 before making a subsequent aging or aging rate measurement or estimate 910.

In another embodiment which is a variation to that depicted in FIG. 7, the brightness is adjusted to keep the aging A lower than a threshold value $A_1$ and aging controls said threshold value. For example, if the aging value increases, said threshold value decreases. The adjustment of the threshold value can be function of display lifetime, and other parameters.

In all the above methods, the minimum and maximum brightness can be set by other factors such as display specifications, application, user setting, and other environmental factors such as environmental brightness.

Any number of the above methods can be used in the display as independent functions and combined. As such, the final display brightness can be controlled by any or all of the above methods. In one embodiment, each method calculates the required brightness and the minimum value from the set of calculated values for brightness is selected. After that, the display brightness is set to the higher of that selected brightness or the minimum allowable brightness.

As described for the above methods, the measurement or estimation of the temperature and aging can occur on a periodic basis, each delay period being set depending upon the particular kind of measurements made and optionally on how the display is responding to management. In general, since the display temperature or aging (absolute or rate values) response to changing brightness is slow, the timing interval for measurement (or estimation), in some embodiments, the time constant of the response is taken into account to avoid oscillation and instability in the above methods. For example, to ensure the effect of any change in brightness is settled, the measurement interval or delay period can be set to be larger than the time constant of the display temperature or aging response. In other embodiments, the measurement interval can be faster than the time constant of the said display response. For these embodiments, the method follows the change in each type of measurement and if the change between two consecutive measurements is less than a threshold then those values are used for adjusting the brightness based on the aforementioned methods. Any another embodiment, the change between more than two consecutive measurements can be used and if the rate of change is stable, then one of those measurements is used for adjusting the display brightness based on at least one of the abovementioned methods.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. A method of adjusting a brightness of an emissive display system:

periodically measuring at least one physical property in at least one area of a display panel generating measurement data;

adjusting the brightness of the display panel with use of the measurement data; wherein the measurement data includes measurements of each at least one physical property; and comparing each measurement of each at least one physical property with at least one threshold generating a respective at least one comparison;

wherein adjusting the brightness of the display panel comprises determining a target brightness for the display panel with use of the measurement data, wherein the target brightness falls within at least one acceptable range of brightness;

wherein the least one physical property comprises a temperature and the at least one threshold comprises a first threshold temperature and a second threshold temperature; and wherein adjusting the brightness of the display panel comprises:

determining the target brightness to be lower than a current brightness when the at least one comparison indicates that the temperature is greater than the first threshold temperature and when the current brightness is greater than a minimum acceptable brightness of said at least one acceptable range of brightness; and determining the target brightness to be higher than the current brightness when the at least one comparison indicates that the temperature is less than the second threshold temperature, and when the current brightness is less than a maximum acceptable brightness of said at least one acceptable range of brightness.

2. A method of adjusting a brightness of an emissive display system:

periodically measuring at least one physical property in at least one area of a display panel generating measurement data; wherein the measurement data includes measurements of each at least one physical property;

comparing each measurement of each at least one physical property with at least one threshold generating a respective at least one comparison;

adjusting the brightness of the display panel with use of the measurement data;

wherein adjusting the brightness of the display panel comprises determining a target brightness for the display panel with use of the measurement data, wherein the target brightness falls within at least one acceptable range of brightness;

wherein the at least one physical property comprises a rate of temperature change and the at least one threshold comprises a first threshold rate of temperature change and a second threshold rate of temperature change, and wherein adjusting the brightness of the display panel comprises:

determining the target brightness to be lower than a current brightness when the at least one comparison indicates that the rate of temperature change is greater than the first threshold rate of temperature change and when the current brightness is greater than a minimum acceptable brightness of said at least one acceptable range of brightness; and determining the target brightness to be higher than the current brightness when the at least one comparison indicates that the rate of temperature change is less than the second threshold rate of temperature change, and when the current brightness is less than a maximum acceptable brightness of said at least one acceptable range of brightness.

3. A method of adjusting a brightness of an emissive display system:

periodically measuring at least one physical property in at least one area of a display panel generating measurement data; wherein the measurement data includes measurements of each at least one physical property;

comparing each measurement of each at least one physical property with at least one threshold generating a respective at least one comparison; and adjusting the brightness of the display panel with use of the measurement data;

wherein adjusting the brightness of the display panel comprises determining a target brightness for the display panel with use of the measurement data, wherein the target brightness falls within at least one acceptable range of brightness; and wherein the at least one physical property comprises a rate of temperature change and a temperature, and the at least one threshold comprises a threshold rate of temperature change and a threshold temperature, and wherein adjusting the brightness of the display panel comprises:

determining the target brightness to be lower than a current brightness when the at least one comparison indicates that the rate of temperature change is greater than the threshold rate of temperature change and the temperature is greater than the threshold temperature and when the current brightness is greater than a minimum acceptable brightness of said at least one acceptable range of brightness; and determining the target brightness to be higher than the current brightness when the at least one comparison indicates that at least one of the rate of temperature change is not greater than the threshold rate of temperature change and the temperature is not greater than the threshold temperature, and when the current brightness is less than a maximum acceptable brightness of said at least one acceptable range of brightness.

4. A method of adjusting a brightness of an emissive display system:

periodically measuring at least one physical property in at least one area of a display panel generating measurement data;

adjusting the brightness of the display panel with use of the measurement data; wherein adjusting the brightness of the display panel comprises determining a target brightness for the display panel with use of the measurement data, wherein the target brightness falls within at least one acceptable range of brightness;

predicting the future state of at least one physical property with use of the measurement data generating at least one predicted physical property value; and comparing the at least one predicted physical property value with at least one threshold generating a respective at least one comparison;

wherein adjusting the brightness of the display panel is performed with use of the at least one comparison;

wherein the at least one physical property comprises a rate of temperature change and a temperature, the at least one predicted physical property value comprises a predicted temperature value, and the at least one threshold comprises a first threshold temperature and a second threshold temperature, and wherein adjusting the brightness of the display panel comprises:

determining the target brightness to be lower than a current brightness when the at least one comparison indicates that the predicted temperature value is greater than the first threshold temperature and when the current brightness is greater than a minimum acceptable brightness of said at least one acceptable range of brightness; and determining the target brightness to be higher than the current brightness when the at least one comparison indicates that the predicted temperature value is less than the second threshold temperature, and when the current brightness is less than a maximum acceptable brightness of said at least one acceptable range of brightness.

5. A method of adjusting a brightness of an emissive display system:

periodically measuring at least one physical property in at least one area of a display panel generating measurement data; wherein the measurement data includes measurements of each at least one physical property;

comparing each measurement of each at least one physical property with at least one threshold generating a respective at least one comparison; and adjusting the brightness of the display panel with use of the measurement data;

wherein adjusting the brightness of the display panel comprises determining a target brightness for the display panel with use of the measurement data, wherein the target brightness falls within at least one acceptable range of brightness;

wherein the at least one physical property comprises a rate of aging and the at least one threshold comprises a first threshold rate of aging and a second threshold rate of aging, and wherein adjusting the brightness of the display panel comprises:

determining the target brightness to be lower than a current brightness when the at least one comparison indicates that the rate of aging is greater than the first threshold rate of aging and when the current brightness is greater than a minimum acceptable brightness of said at least one acceptable range of brightness; and determining the target brightness to be higher than the current brightness when the at least one comparison indicates that the rate of aging is less than the second threshold rate of aging, and when the current brightness is less than a maximum acceptable brightness of said at least one acceptable range of brightness.

6. A method of adjusting a brightness of an emissive display system:

periodically measuring at least one physical property in at least one area of a display panel generating measurement data; wherein the measurement data includes measurements of each at least one physical property;

comparing each measurement of each at least one physical property with at least one threshold generating a respective at least one comparison; and adjusting the brightness of the display panel with use of the measurement data;

wherein adjusting the brightness of the display panel comprises determining a target brightness for the display panel with use of the measurement data, wherein the target brightness falls within at least one acceptable range of brightness;

wherein the at least one physical property comprises aging and the at least one threshold comprises a first threshold aging and a second threshold aging, and wherein adjusting the brightness of the display panel comprises:

determining the target brightness to be lower than a current brightness when the at least one comparison indicates that the aging is greater than the first threshold aging and when the current brightness is greater than a minimum acceptable brightness of said at least one acceptable range of brightness; and determining the target brightness to be higher than the current brightness when the at least one comparison indicates that the aging is greater than the second threshold aging, and when the current brightness is less than a maximum acceptable brightness of said at least one acceptable range of brightness.

7. A method of adjusting a brightness of an emissive display system:

periodically measuring at least one physical property in at least one area of a display panel generating measurement data; wherein the measurement data includes measurements of each at least one physical property;

comparing each measurement of each at least one physical property with at least one threshold generating a respective at least one comparison; and adjusting the brightness of the display panel with use of the measurement data;

wherein adjusting the brightness of the display panel comprises determining a target brightness for the display panel with use of the measurement data, wherein the target brightness falls within at least one acceptable range of brightness;

wherein the at least one physical property comprises aging and a rate of aging, and the at least one threshold comprises a plurality of aging thresholds and a corresponding plurality of threshold aging rates, and wherein adjusting the brightness of the display panel comprises:

determining the target brightness when the at least one comparison indicates that the aging is greater than the one of the plurality of aging threshold and the rate of aging is greater than the corresponding one of the plurality of threshold aging rates.

8. A display system comprising:

a display panel having an array of pixels that each include a drive transistor and a light emitting device, multiple select lines coupled to said array for delivering signals that select when each pixel is to be driven, multiple data lines for delivering drive signals to the selected pixels, and multiple monitor lines for conveying signals from each pixel; and a monitor system for periodically measuring at least one physical property in at least one area of the display with use of signals over the monitor lines to pixels of the at least one area generating measurement data; wherein the measurement data includes measurements of each at least one physical property;

a memory store for storing the measurement data; and a controller adapted to adjust the brightness of the display panel with use of the measurement data;

wherein the controller is adapted to:

compare each measurement of each at least one physical property with at least one threshold generating a respective at least one comparison; and adjust the brightness of the display panel by determining a target brightness for the display panel with use of the measurement data, wherein the target brightness falls within at least one acceptable range of brightness;

wherein the at least one physical property comprises a temperature, and the at least one threshold comprises a first threshold temperature and a second threshold temperature, and wherein the controller is adapted to adjust the brightness of the display panel by:

determining the target brightness to be lower than a current brightness when the at least one comparison indicates that the temperature is greater than the first threshold temperature and when the current brightness is greater than a minimum acceptable brightness of said at least one acceptable range of brightness; and determining the target brightness to be higher than the current brightness when the at least one comparison indicates that the temperature is greater than the second threshold temperature, and when the current brightness is less than a maximum acceptable brightness of said at least one acceptable range of brightness.

9. A display system comprising:

a display panel having an array of pixels that each include a drive transistor and a light emitting device, multiple select lines coupled to said array for delivering signals that select when each pixel is to be driven, multiple data lines for delivering drive signals to the selected pixels, and multiple monitor lines for conveying signals from each pixel; and a monitor system for periodically measuring at least one physical property in at least one area of the display with use of signals over the monitor lines to pixels of the at least one area generating measurement data;

a memory store for storing the measurement data; and a controller adapted to:

adjust the brightness of the display panel with use of the measurement data;

predict the future state of at least one physical property with use of the measurement data generating at least one predicted physical property value; and compare the at least one predicted physical property value with at least one threshold generating a respective at least one comparison, adjust the brightness of the display panel with use of the at least one comparison;

wherein the controller is adapted to adjust the brightness of the display panel by determining a target brightness for the display panel with use of the measurement data, wherein the target brightness falls within at least one acceptable range of brightness; and wherein the at least one physical property comprises a rate of temperature change, and the at least one threshold comprises a first threshold rate of temperature change and a second threshold rate of temperature change, wherein the controller is adapted to adjust the brightness of the display panel by:

determining the target brightness to be lower than a current brightness when the at least one comparison indicates that the rate of temperature change is greater than the first threshold rate of temperature change and when the current brightness is greater than a minimum acceptable brightness of said at least one acceptable range of brightness; and determining the target brightness to be higher than the current brightness when the at least one comparison indicates that the rate of temperature change is greater than the second threshold rate of temperature change, and when the current brightness is less than a maximum acceptable brightness of said at least one acceptable range of brightness.

10. A display system comprising:

a display panel having an array of pixels that each include a drive transistor and a light emitting device, multiple select lines coupled to said array for delivering signals that select when each pixel is to be driven, multiple data lines for delivering drive signals to the selected pixels, and multiple monitor lines for conveying signals from each pixel;

a monitor system for periodically measuring at least one physical property in at least one area of the display with use of signals over the monitor lines to pixels of the at least one area generating measurement data; wherein the measurement data includes measurements of each at least one physical property;

a memory store for storing the measurement data; and a controller adapted to:

compare each measurement of each at least one physical property with at least one threshold generating a respective at least one comparison; and adjust the brightness of the display panel with use of the measurement data;

wherein the controller is adapted to adjust the brightness of the display panel by determining a target brightness for the display panel with use of the measurement data, wherein the target brightness falls within at least one acceptable range of brightness;

wherein the at least one physical property comprises a rate of temperature change and a temperature, and the at least one threshold comprises a threshold rate of temperature change and a threshold temperature, and wherein the controller is adapted to adjust the brightness of the display panel by:

determining the target brightness to be lower than a current brightness when the at least one comparison indicates that the rate of temperature change is greater than the threshold rate of temperature change and the temperature is greater than the first threshold temperature and when the current brightness is greater than a minimum acceptable brightness of said at least one acceptable range of brightness; and determining the target brightness to be higher than the current brightness when the at least one comparison indicates that at least one of the rate of temperature change is not greater than the threshold rate of temperature change and the temperature is not greater than the second threshold temperature, and when the current brightness is less than a maximum acceptable brightness of said at least one acceptable range of brightness.

11. A display system comprising:

a display panel having an array of pixels that each include a drive transistor and a light emitting device, multiple select lines coupled to said array for delivering signals that select when each pixel is to be driven, multiple data lines for delivering drive signals to the selected pixels, and multiple monitor lines for conveying signals from each pixel; and a monitor system for periodically measuring at least one physical property in at least one area of the display with use of signals over the monitor lines to pixels of the at least one area generating measurement data; wherein the measurement data includes measurements of each at least one physical property;

a memory store for storing the measurement data; and a controller adapted to predict the future state of at least one physical property with use of the measurement data generating at least one predicted physical property value;

compare each measurement of each at least one physical property and each at least one predicted physical property value with at least one threshold generating a respective at least one comparison; and adjust the brightness of the display panel by determining a target brightness for the display panel with use of the measurement data, wherein the target brightness falls within at least one acceptable range of brightness;

wherein the at least one physical property comprises a rate of temperature change and a temperature, the at least one predicted physical property value comprises a predicted temperature value, and the at least one threshold comprises a first threshold temperature and a second threshold temperature, and wherein the controller is adapted to adjust the brightness of the display panel by:

determining the target brightness to be lower than a current brightness when the at least one comparison indicates that the predicted temperature value is greater than the first threshold temperature and when the current brightness is greater than a minimum acceptable brightness of said at least one acceptable range of brightness; and determining the target brightness to be higher than the current brightness when the at least one comparison indicates that the predicted temperature value is not greater than the second threshold temperature, and when the current brightness is less than a maximum acceptable brightness of said at least one acceptable range of brightness.

12. A display system comprising:

a display panel having an array of pixels that each include a drive transistor and a light emitting device, multiple select lines coupled to said array for delivering signals that select when each pixel is to be driven, multiple data lines for delivering drive signals to the selected pixels, and multiple monitor lines for conveying signals from each pixel; and a monitor system for periodically measuring at least one physical property in at least one area of the display with use of signals over the monitor lines to pixels of the at least one area generating measurement data; wherein the measurement data includes measurements of each at least one physical property;

a memory store for storing the measurement data; and a controller adapted to compare each measurement of each at least one physical property with at least one threshold generating a respective at least one comparison; and adjust the brightness of the display panel by determining a target brightness for the display panel with use of the measurement data, wherein the target brightness falls within at least one acceptable range of brightness;

wherein the at least one physical property comprises a rate of aging and the at least one threshold comprises a first threshold rate of aging and a second threshold rate of aging, and wherein the controller is adapted to adjust the brightness of the display panel by:

determining the target brightness to be lower than a current brightness when the at least one comparison indicates that the rate of aging is greater than the first threshold rate of aging and when the current brightness is greater than a minimum acceptable brightness of said at least one acceptable range of brightness; and determining the target brightness to be higher than the current brightness when the at least one comparison indicates that the rate of aging is greater than the second threshold rate of aging, and when the current brightness is less than a maximum acceptable brightness of said at least one acceptable range of brightness.

13. A display system comprising:

a display panel having an array of pixels that each include a drive transistor and a light emitting device, multiple select lines coupled to said array for delivering signals that select when each pixel is to be driven, multiple data lines for delivering drive signals to the selected pixels, and multiple monitor lines for conveying signals from each pixel;

a monitor system for periodically measuring at least one physical property in at least one area of the display with use of signals over the monitor lines to pixels of the at least one area generating measurement data; wherein the measurement data includes measurements of each at least one physical property;

a memory store for storing the measurement data; and a controller adapted to compare each measurement of each at least one physical property with at least one threshold generating a respective at least one comparison; and adjust the brightness of the display panel by determining a target brightness for the display panel with use of the measurement data, wherein the target brightness falls within at least one acceptable range of brightness;

wherein the at least one physical property comprises aging and the at least one threshold comprises a first threshold aging and a second threshold aging, and wherein the controller is adapted to adjust the brightness of the display panel by:

determining the target brightness to be lower than a current brightness when the at least one comparison indicates that the aging is greater than the first threshold aging and when the current brightness is greater than a minimum acceptable brightness of said at least one acceptable range of brightness; and determining the target brightness to be higher than the current brightness when the at least one comparison indicates that the aging is greater than the second threshold aging, and when the current brightness is less than a maximum acceptable brightness of said at least one acceptable range of brightness.

14. A display system comprising:

a display panel having an array of pixels that each include a drive transistor and a light emitting device, multiple select lines coupled to said array for delivering signals that select when each pixel is to be driven, multiple data lines for delivering drive signals to the selected pixels, and multiple monitor lines for conveying signals from each pixel; and a monitor system for periodically measuring at least one physical property in at least one area of the display with use of signals over the monitor lines to pixels of the at least one area generating measurement data; wherein the measurement data includes measurements of each at least one physical property;

a memory store for storing the measurement data; and a controller adapted to compare each measurement of each at least one physical property with at least one threshold generating a respective at least one comparison; and adjust the brightness of the display panel by determining a target brightness for the display panel with use of the measurement data, wherein the target brightness falls within at least one acceptable range of brightness;

wherein the at least one physical property comprises aging and a rate of aging, and the at least one threshold comprises a plurality of aging thresholds and a corresponding plurality of threshold aging rates, and wherein the controller is adapted to adjust the brightness of the display panel by determining the target brightness when the at least one comparison indicates that the aging is greater than the one of the plurality of aging threshold and the rate of aging is greater than the corresponding one of the plurality of threshold aging rates.

* * * * *